US011430376B2

(12) United States Patent
Jang

(10) Patent No.: US 11,430,376 B2
(45) Date of Patent: Aug. 30, 2022

(54) DISPLAY DEVICE INCLUDING LIGHT EMITTING ELEMENTS AND A BYPASS UNIT

(71) Applicant: Samsung Display Co., Ltd., Yongin-si (KR)

(72) Inventor: Jin Won Jang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/242,923

(22) Filed: Apr. 28, 2021

(65) Prior Publication Data

US 2021/0383742 A1 Dec. 9, 2021

(30) Foreign Application Priority Data

Jun. 4, 2020 (KR) ..... 10-2020-0067541

(51) Int. Cl.
*G09G 3/32* (2016.01)
*G09G 3/3233* (2016.01)
*G09G 3/3258* (2016.01)

(52) U.S. Cl.
CPC ..... *G09G 3/32* (2013.01); *G09G 3/3233* (2013.01); *G09G 3/3258* (2013.01); *G09G 2300/0426* (2013.01); *G09G 2310/0291* (2013.01)

(58) Field of Classification Search
CPC ..... G09G 3/32; G09G 3/3233; G09G 3/325; G09G 3/3258; G09G 2300/0426; G09G 2310/0291; G09G 2330/025; H01L 27/3246; H01L 27/3248; H01L 27/3262; H01L 27/156; H03F 3/45475
See application file for complete search history.

(56) References Cited

U.S. PATENT DOCUMENTS 9,324,264 B2 * 4/2016 Jeong ..... G09G 3/325
9,728,134 B2 * 8/2017 Jeong ..... G09G 3/3291
10,600,365 B2 * 3/2020 Jeong ..... G09G 3/3258
2017/0330515 A1 * 11/2017 Jeong ..... G09G 3/3266

FOREIGN PATENT DOCUMENTS

KR 10-2011-0101938 A 9/2011
KR 10-2020-0013190 A 2/2020

* cited by examiner

*Primary Examiner* — Vijay Shankar
(74) *Attorney, Agent, or Firm* — Lewis Roca Rothgerber Christie LLP

(57) ABSTRACT

A display device includes a plurality of pixels on a substrate, each of the plurality of pixels including a pixel circuit to drive a plurality of light emitting elements, wherein the pixel circuit of each of the plurality of pixels includes: a first transistor configured to supply a driving current to a first electrode of the light emitting elements; and a plurality of light emitting groups, each of the light emitting groups including some of the light emitting elements and a bypass unit connected between the first electrode and a second electrode of the some of the light emitting elements to selectively bypass a part of the driving current.

20 Claims, 16 Drawing Sheets

ED: ED11~EDnm
EDG: EDG1~EDGn
CP: CP1~CPn
RS: RS1~RSn

CP: CP1~CPn
AMP: AMP1~AMPn
TC: TC1~TCn
RC: RC1~RCn
RS: RS1~RSn

CP: CP1~CPn
AMP: AMP1~AMPn
TC: TC1~TCn
RC: RC1~RCn
RS: RS1~RSn

CP: CP1~CPn
CD: CD1~CDn
TC: TC1~TCn
RS:RS1~RSn

CP: CP1~CPn
CD: CD1~CDn
TC: TC1~TCn
RS: RS1~RSn

CP: CP1~CPn
RC: RC1~RCn
TC: TC1~TCn
RS: RS1~RSn

CP: CP1~CPn
RC: RC1~RCn
TC: TC1~TCn
RS: RS1~RSn

ED: ED11~EDnm
EDG: EDG1~EDGn
CP: CP1~CPn
RS: RS1~RSn

DISPLAY DEVICE INCLUDING LIGHT EMITTING ELEMENTS AND A BYPASS UNIT

CROSS-REFERENCE TO RELATED APPLICATION

This application claims priority to and the benefit of Korean Patent Application No. 10-2020-0067541 filed on Jun. 4, 2020, in the Korean Intellectual Property Office, and all the benefits accruing therefrom under 35 U.S.C. 119, the content of which in its entirety is herein incorporated by reference.

BACKGROUND

1. Field

The present disclosure relates to a display device.

2. Description of the Related Art

With the advancement of information-oriented society, more and more demands are being placed on display devices for displaying images in various ways. For example, display devices are employed in various electronic devices such as smartphones, digital cameras, laptop computers, navigation devices, and smart televisions. The display device may be a flat panel display device such as a liquid crystal display device, a field emission display device, and an organic light emitting display device. Among the flat panel display devices, in the light emitting display device, because each of pixels of a display panel includes a light emitting element capable of emitting light by itself, an image can be displayed without a backlight unit for providing light to the display panel.

Each of the plurality of pixels of the display panel may include a plurality of light emitting elements. The plurality of light emitting elements may emit light by a driving current supplied from a pixel circuit of the pixel. In this case, when some of the plurality of light emitting elements are not conductive, the driving current may be concentrated in the other light emitting elements, and a hotspot phenomenon or deterioration may occur in the other light emitting elements.

SUMMARY

Aspects and example embodiments of the present disclosure provide a display device that is capable of preventing a hotspot phenomenon of a light emitting element and preventing deterioration of the light emitting element by preventing an overcurrent from flowing through the light emitting element.

However, aspects of the present disclosure are not restricted to the one set forth herein. The above and other aspects of the present disclosure will become more apparent to one of ordinary skill in the art to which the present disclosure pertains by referencing the detailed description of the present disclosure given below.

According to some embodiments of the present disclosure, a display device includes a plurality of pixels on a substrate, each of the plurality of pixels including a pixel circuit to drive a plurality of light emitting elements. The pixel circuit of each of the plurality of pixels includes: a first transistor configured to supply a driving current to a first electrode of the light emitting elements, and a plurality of light emitting groups, each of the light emitting groups including some of the light emitting elements and a bypass unit connected between the first electrode and a second electrode of the some of the light emitting elements to selectively bypass a part of the driving current.

The bypass unit may be configured to allow a part of the driving current to pass therethrough based on a voltage of the second electrode of the some of the light emitting elements.

When some of the light emitting groups are electrically opened and the driving current does not pass therethrough, bypass units of other ones of the light emitting groups may allow a part of the driving current to pass therethrough.

The bypass unit may include: an amplifier configured to compare a voltage of the second electrode of the some of the light emitting elements with a reference voltage to supply an output voltage, and a compensation transistor connected to the first electrode of the some of the light emitting elements and configured to allow a part of the driving current to pass therethrough based on the output voltage of the amplifier.

The amplifier is configured to output a gate-on voltage to turn on the compensation transistor when the voltage of the second electrode of the some of the light emitting elements is greater than the reference voltage.

The bypass unit may include: a compensation transistor connected to the first electrode of the some of the light emitting elements and is configured to turned on based on a voltage of the second electrode of the some of the light emitting elements, and a compensation diode connected between the compensation transistor and the second electrode of the some of the light emitting elements.

The compensation transistor is configured to supply a part of the driving current to the compensation diode when the voltage of the second electrode of the some of the light emitting elements is greater than a gate-on voltage.

The bypass unit may include a compensation transistor connected to the first electrode of the some of the light emitting elements and is configured to turned on based on a voltage of the second electrode of the some of the light emitting elements to allow a part of the driving current to pass therethrough.

The bypass unit may further include a first conductive pattern connected between the compensation transistor and the second electrode of the some of the light emitting elements. When the voltage of the second electrode of the some of the light emitting elements is greater than a gate-on voltage, the compensation transistor may supply a part of the driving current to the first conductive pattern.

The display device may further include a semiconductor layer on the substrate. A semiconductor area of the first transistor, a semiconductor area of the compensation transistor, and the first conductive pattern may be in the semiconductor layer.

The pixel circuit of each of the pixels may further include: a first connection electrode connecting the first electrode of the light emitting elements to a first electrode of the compensation transistor, a second connection electrode connecting a second electrode of the compensation transistor to the first conductive pattern, and a third connection electrode connecting the first conductive pattern to the second electrode of the light emitting elements.

The pixel circuit of each of the pixels may further include: a first anode connection electrode at a same layer as at least one of the first to third connection electrodes and connected to a second electrode of the first transistor, a second anode connection electrode on the first anode connection electrode to connect the first anode connection electrode to the first electrode of the light emitting elements, a second conductive pattern in the semiconductor layer and connected to the third connection electrode, and a low potential line at a same layer as the second anode connection electrode and connected to the second conductive pattern.

The first electrode of the light emitting elements is connected to the first transistor, the pixel circuit further including a plurality of second electrodes respectively corresponding to the light emitting groups.

The first electrode may include: a first portion extending in a first direction, and a second portion protruding from the first portion in a second direction crossing the first direction.

Each of the second electrodes may include: a first portion adjacent to the first portion of the first electrode, and a second portion protruding from the first portion of each of the second electrodes in an opposite direction to an extending direction of the first portion of the first electrode.

The bypass unit may further include a compensation transistor connected between the first electrode and the second electrode of the some of the light emitting elements. The first electrode of the some of the light emitting elements may be connected to the compensation transistor through a first contact hole in the second portion of the first electrode. The second electrode of the some of the light emitting elements may be connected to the compensation transistor through a second contact hole in the second portion of the second electrode.

The pixel circuit of each of the pixels may further include: a first contact electrode on the first portion of the first electrode and in direct contact with a first semiconductor portion of each of the light emitting elements, and a plurality of second contact electrodes, each being on the first portion of each of the second electrodes and in direct contact with a second semiconductor portion of each of the light emitting elements.

Each of the second electrodes may be connected to a corresponding one of a plurality of second conductive patterns. The second conductive patterns may be connected to one low potential line.

The pixel circuit of each of the pixels may further include: a second transistor selectively supplying a data voltage to a first node that is a first electrode of the first transistor, a third transistor selectively connecting a second node that is a second electrode of the first transistor to a third node that is a gate electrode of the first transistor, a fourth transistor selectively supplying an initialization voltage to the third node, a fifth transistor selectively supplying a driving voltage to the first node, a sixth transistor selectively connecting the second node to a fourth node which is a first electrode of the light emitting elements, and a seventh transistor selectively supplying the initialization voltage to the fourth node.

The pixel circuit of each of the pixels may further include: a second transistor selectively supplying a data voltage to a first node which is a gate electrode of the first transistor, a third transistor selectively supplying an initialization voltage to a second node which is the first electrode of the light emitting elements, and a capacitor connected between the first node and the second node.

The display device according to embodiments includes a bypass unit connected to a plurality of light emitting elements in each of a plurality of light emitting groups. Accordingly, even when some of the plurality of light emitting groups do not allow a driving current to pass therethrough, it is possible to distribute a driving current flowing through light emitting elements of the other light emitting groups. Therefore, the display device can prevent the overcurrent from flowing through the light emitting element, thereby preventing the hotspot phenomenon of the light emitting element and the consequent deterioration of the light emitting element.

The effects of the present disclosure are not limited to the aforementioned effects, and various other effects are included in the present specification.

BRIEF DESCRIPTION OF THE DRAWINGS

The above and other aspects and features of the present disclosure will become more apparent by describing in detail example embodiments thereof with reference to the attached drawings, in which.

DETAILED DESCRIPTION

Figure 1:
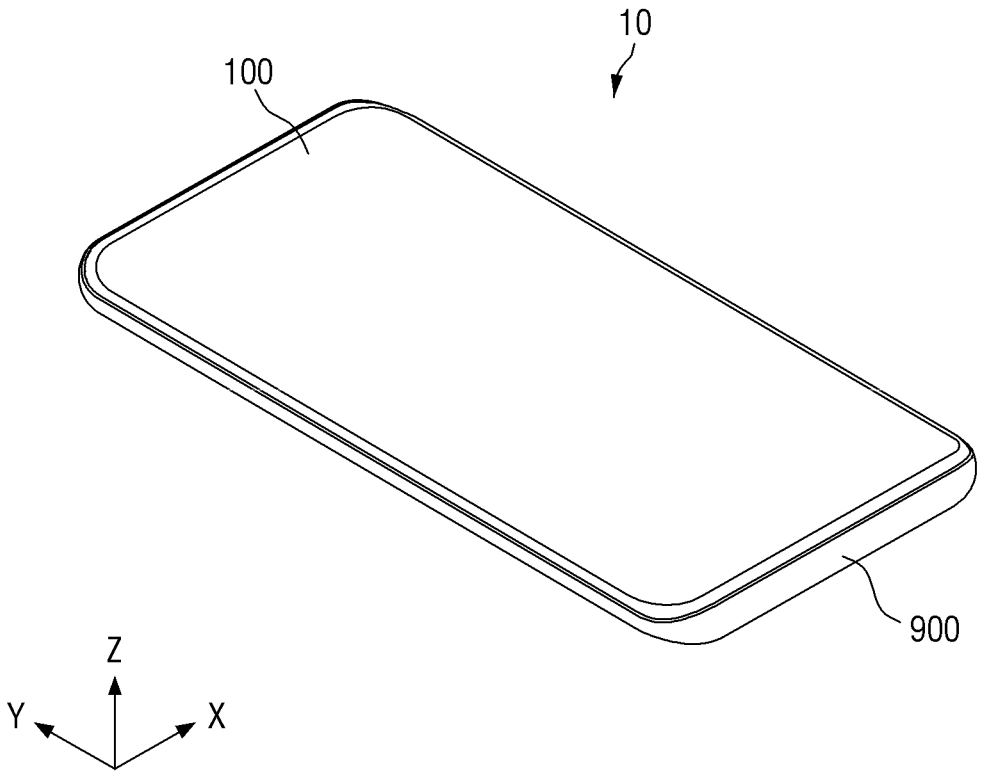
FIG. 1 is a perspective view illustrating a display device according to one or more example embodiments.

In the following description, for the purposes of explanation, numerous specific details are set forth in order to provide a thorough understanding of various example embodiments or implementations of the present disclosure. As used herein "embodiments" and "implementations" are interchangeable words that are non-limiting examples of devices or methods employing one or more of the inventive concepts disclosed herein. It is apparent, however, that various example embodiments may be practiced without these specific details or with one or more equivalent arrangements. In other instances, well-known structures and devices are shown in block diagram form in order to avoid unnecessarily obscuring various example embodiments. Further, various example embodiments may be different, but do not have to be exclusive. For example, specific shapes, configurations, and characteristics of an example embodiment may be used or implemented in another example embodiment without departing from the scope of the present disclosure.

Unless otherwise specified, the illustrated example embodiments are to be understood as providing example features of varying detail of some ways in which the example embodiments may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the scope of the present disclosure.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an example embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements.

Further, the X-axis, the Y-axis, and the Z-axis are not limited to three axes of a rectangular coordinate system, such as the x, y, and z axes, and may be interpreted in a broader sense. For example, the X-axis, the Y-axis, and the Z-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the example term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various example embodiments are described herein with reference to sectional and/or exploded illustrations that are schematic illustrations of idealized example embodiments and/or intermediate structures. As such, variations from the shapes of the illustrations as a result, for example, of manufacturing techniques and/or tolerances, are to be expected. Thus, example embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some example embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some example embodiments may be physically separated into two or more interacting and discrete blocks, units, and/or modules without departing from the scope of the inventive concepts. Further, the blocks, units, and/or modules of some example embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
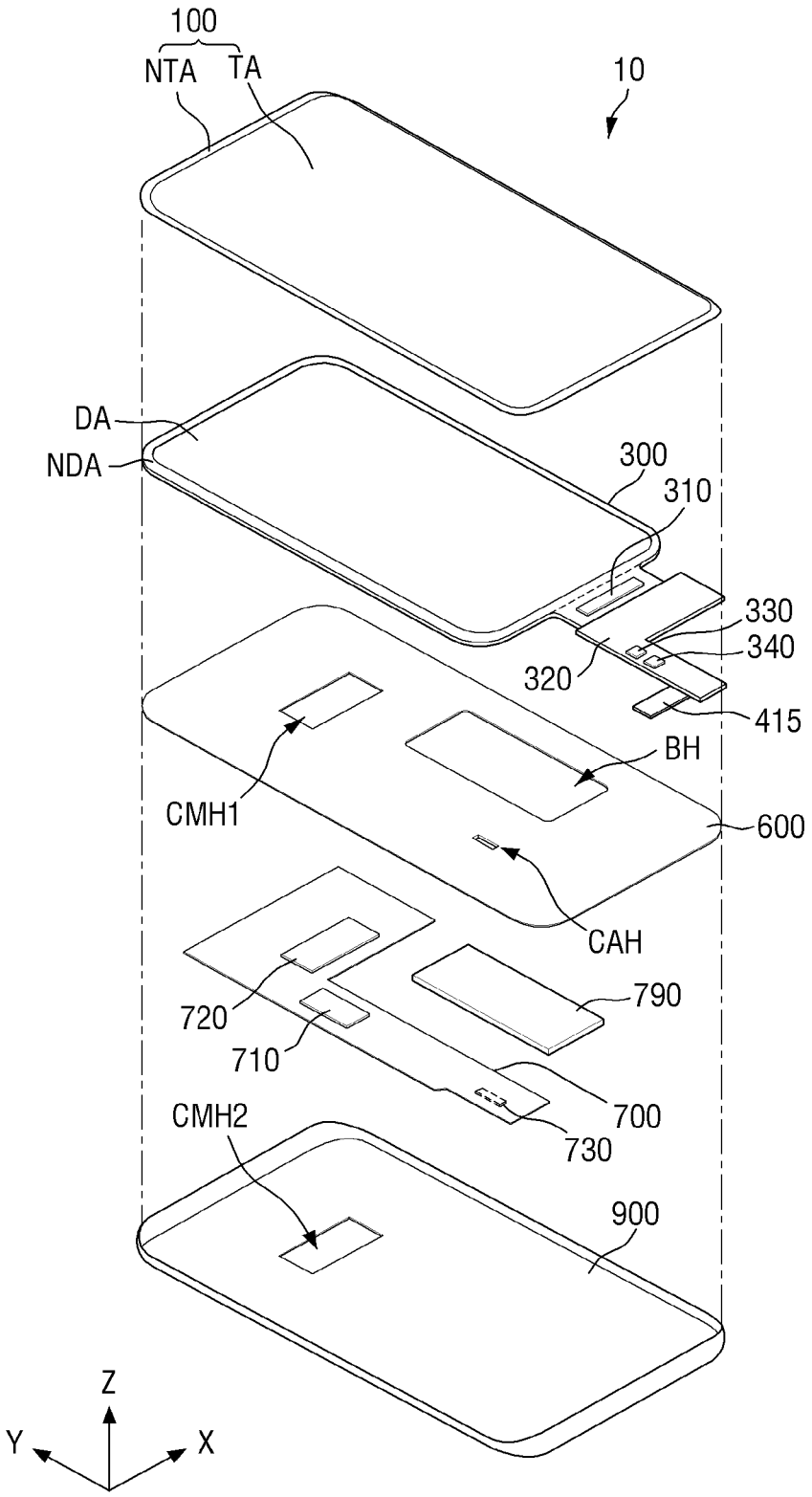
FIG. 2 is an exploded perspective view illustrating a display device according to one or more example embodiments.

FIG. 1 is a perspective view illustrating a display device according to one or more example embodiments. FIG. 2 is an exploded perspective view illustrating a display device according to one or more example embodiments.

Referring to FIGS. 1 and 2, a display device 10 includes a cover window 100, a display panel 300, a bracket 600, a main circuit board 700, and a lower cover 900.

The terms "above," "top" and "upper surface" as used herein refer to an upward direction (i.e., a Z-axis direction) with respect to the display device 10. The terms "below," "bottom" and "lower surface" as used herein refer to a downward direction (i.e., a direction opposite to the Z-axis direction) with respect to the display device 10. Further, "left", "right", "upper" and "lower" indicate directions when the display device 10 is viewed from above. For example, the term "left" indicates a negative direction on the X-axis, the term "right" indicates a positive direction on the X-axis, the term "up" indicates a positive direction on the Y-axis, and the term "down" indicates a negative direction on the Y-axis.

The display device 10 is a device for displaying a moving image or a still image. The display device 10 may be used as a display screen of various products such as televisions, laptop computers, monitors, billboards, and the Internet of Things (IOT) as well as portable electronic devices such as mobile phones, smart phones, tablet personal computers (tablet PCs), smart watches, watch phones, mobile communication terminals, electronic notebooks, electronic books, portable multimedia players (PMPs), navigation systems and ultra mobile PCs (UMPCs).

The display device 10 may have a rectangular shape in plan view. For example, the display device 10 may have a rectangular shape, in plan view, having short sides extending in a first direction (X-axis direction) and long sides extending in a second direction (Y-axis direction), as shown in FIGS. 1 and 2. The corner where the short side extending in the first direction (X-axis direction) and the long side extending in the second direction (Y-axis direction) meet may be rounded to have a curvature (e.g., a predetermined curvature) or may be right-angled. The planar shape of the display device 10 is not limited to a rectangular shape, and may be formed in other polygonal shapes, a circular shape, or elliptical shape.

The cover window 100 may be disposed on the display panel 300 to cover the top surface of the display panel 300. The cover window 100 may protect the top surface of the display panel 300.

The cover window 100 may include a transmissive area TA corresponding to a display area DA of the display panel 300 and a non-transmissive area NTA corresponding to a non-display area NDA of the display panel 300. For example, the non-transmissive area NTA may be formed opaquely. For another example, the non-transmissive area NTA may be formed as a decorative layer having a pattern that can be displayed to a user when an image is not displayed.

The display panel 300 may be disposed below the cover window 100. Accordingly, the image displayed by the display panel 300 may be seen on the top surface of the display device 10 through the cover window 100.

The display panel 300 may be a light emitting display panel including a light emitting element. For example, the display panel 300 may be an organic light emitting display panel using an organic light emitting diode including an organic light emitting layer, a micro light emitting diode display panel using a micro LED, a quantum dot light emitting display panel using a quantum dot light emitting diode including a quantum dot light emitting layer, or an inorganic light emitting display panel using an inorganic light emitting element including an inorganic semiconductor.

The display panel 300 may include the display area DA and the non-display area NDA.

The display area DA may be disposed to overlap the transmissive area TA of the cover window 100. The display area DA may include a plurality of pixels displaying an image, and the non-display area NDA which is a peripheral area of the display area DA may not display an image. For example, the non-display area NDA may surround the display area DA along the edge or periphery of the display area DA, but is not limited thereto. The display area DA may occupy most of the area of the display panel 300.

For example, the display panel 300 may include a touch electrode layer for sensing an object such as a human finger, a pen or the like. The touch electrode layer may include a plurality of touch electrodes, and may be disposed on a display layer on which the plurality of pixels are disposed.

The display panel 300 may include a display driver 310, a circuit board 320, a power supply unit 330, and a touch driver 340.

The display driver 310 may output signals and voltages for driving the display panel 300. For example, the display driver 310 may supply a data voltage to the data line. The display driver 310 may supply a driving voltage or a source voltage to a driving voltage line, and may supply a gate control signal to the gate driver.

The circuit board 320 may be attached on a pad portion using an anisotropic conductive film (ACF). The lead lines of the circuit board 320 may be electrically connected to the pad portion of the display panel 300. For example, the circuit board 320 may be a flexible film, such as a flexible printed circuit board, a printed circuit board (PCB), or a chip on film (COF).

The power supply unit 330 may be disposed on the circuit board 320 to supply a driving voltage to the display driver 310 and the display panel 300. For example, the power supply unit 330 may generate a driving voltage and supply it to the driving voltage line, and the power supply unit 330 may generate a common voltage and supply it to a low potential line. For example, the driving voltage may be a high potential voltage for driving the light emitting element, and the common voltage may be a low potential voltage for driving the light emitting element.

The touch driver 340 may be disposed on the circuit board 320 to measure the capacitance of the touch electrodes. For example, the touch driver 340 may determine whether the user has touched, the location of the user's touch and the like, based on the change in capacitance of the touch electrodes. Here, the user's touch means that an object such as a user's finger or pen is in direct contact with one surface of the display device 10 disposed on a touch electrode layer. The touch driver 340 may determine the user's touch position by distinguishing a portion of the plurality of touch electrodes where the user's touch occurs from a portion where no touch occurs.

The bracket 600 may be disposed below the display panel 300. The bracket 600 may be made of plastic, metal, or a combination thereof. For example, the bracket 600 may include a first camera hole CMH1 into which a first camera sensor 720 is inserted, a battery hole BH in which a battery 790 is disposed, and a cable hole CAH through which a cable 415 connected to the display driver 310 or the circuit board 320 passes.

The main circuit board 700 and the battery 790 may be disposed below the bracket 600. The main circuit board 700 may be a printed circuit board or a flexible printed circuit board.

The main circuit board 700 may include a main processor 710, a first camera sensor 720, and a main connector 730. The first camera sensor 720 may be disposed on both the top and bottom surfaces of the main circuit board 700, the main processor 710 may be disposed on the top surface of the main circuit board 700, and the main connector 730 may be disposed on the bottom surface of the main circuit board 700.

The main processor 710 may control all functions of the display device 10. For example, the main processor 710 may supply digital video data to the display driver 310 such that the display panel 300 displays an image. The main processor 710 may receive touch data from the touch driver 340 and determine the user's touch coordinates, and then execute an application indicated by an icon displayed on the user's touch coordinates.

The main processor 710 may convert first image data inputted from the first camera sensor 720 into digital video data and outputs it to the display driver 310 through the circuit board 320, thereby displaying an image captured by the first camera sensor 720 on the display panel 300.

The first camera sensor 720 may process an image frame of a still image or video obtained by the image sensor and output it to the main processor 710. For example, the first camera sensor 720 may be a complementary metal-oxide-semiconductor (CMOS) image sensor or a charge-coupled device (CCD) sensor, but is not limited thereto. The first camera sensor 720 may be exposed to the lower surface of the lower cover 900 by a second camera hole CMH2, and capture an image of a background or an object disposed below or in proximity to the display device 10.

The main connector 730 may be connected to the cable 415 that has passed through the cable hole CAH of the bracket 600. Thus, the main circuit board 700 may be electrically connected to the display driver 310 or the circuit board 320.

The battery 790 may be disposed so as not to overlap the main circuit board 700 in a third direction (Z-axis direction). The battery 790 may overlap the battery hole BH of the bracket 600.

The main circuit board 700 may further include a mobile communication module capable of transmitting and receiving radio signals with at least one of a base station, an external terminal, and a server in a mobile communication network. The wireless signal may include various types of data according to transmission and reception of a voice signal, a video call signal, or a text/multimedia message.

The lower cover 900 may be disposed below the main circuit board 700 and the battery 790. The lower cover 900 may be fixed by being fastened to the bracket 600. The lower cover 900 may form an external appearance of the bottom surface of the display device 10. The lower cover 900 may be made of plastic, metal, or a combination thereof.

The lower cover 900 may include a second camera hole CMH2 through which the lower surface of the first camera sensor 720 is exposed to outside. The position of the first camera sensor 720 and the positions of the first and second camera holes CMH1 and CMH2 corresponding to the first camera sensor 720 are not limited to the embodiment illustrated in FIG. 2.

Figure 3:
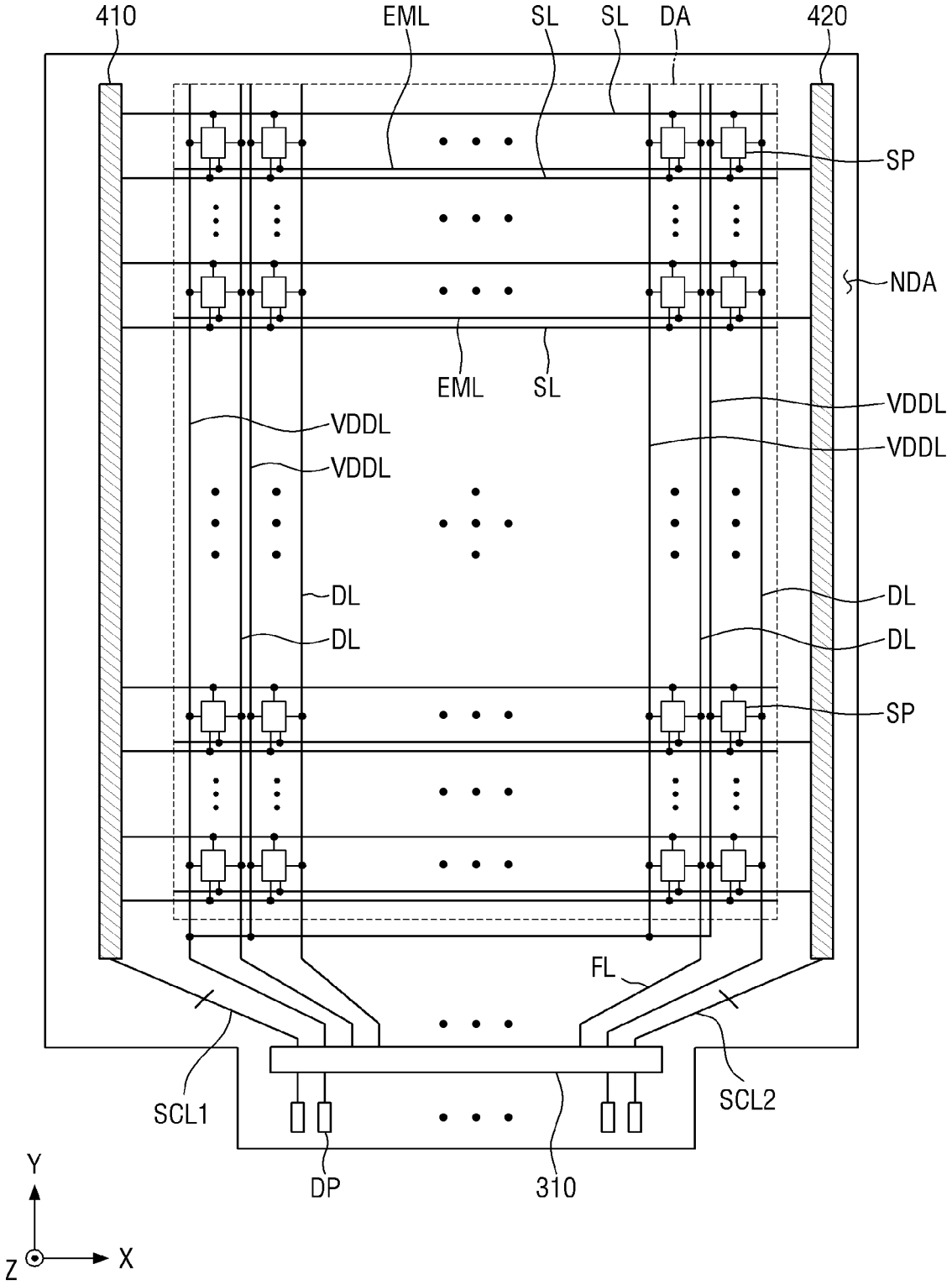
FIG. 3 is a plan view illustrating a display panel according to one or more example embodiments.
Figure 4:
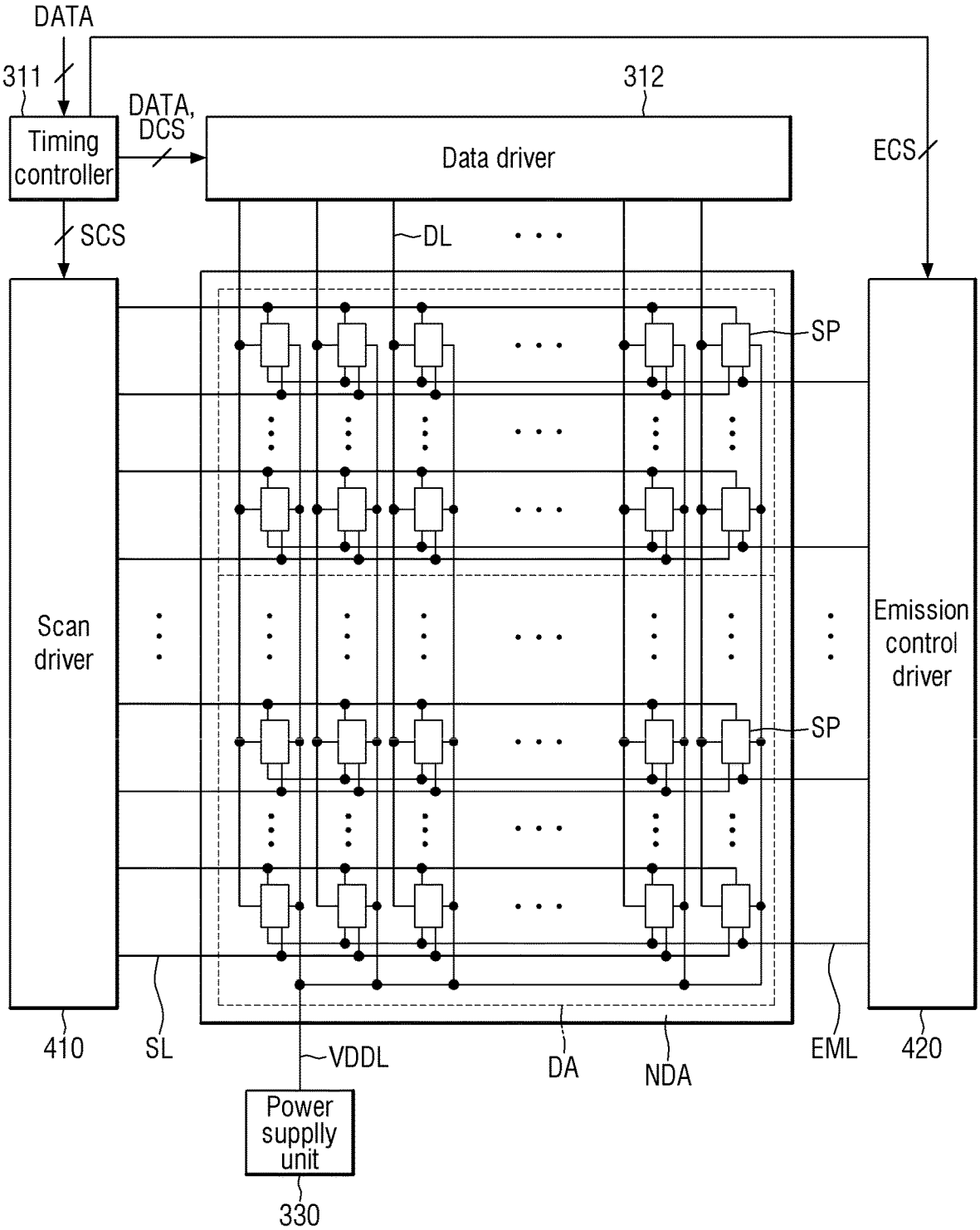
FIG. 4 is a block diagram illustrating a display panel and a display driver according to one or more example embodiments.

FIG. 3 is a plan view illustrating a display panel according to one or more example embodiments. FIG. 4 is a block diagram illustrating a display panel and a display driver according to one or more example embodiments.

Referring to FIGS. 3 and 4, the display panel 300 may include the display area DA and the non-display area NDA.

The display area DA may include a plurality of pixels SP, and driving voltage lines VDDL, scan lines SL, emission control lines EML, and data lines DL connected to the plurality of pixels SP.

The pixels SP may be connected to at least one scan line SL, at least one data line DL, at least one emission control line EML, and at least one driving voltage line VDDL. In FIGS. 3 and 4, each of the pixels SP may be connected to two scan lines SL, one data line DL, one emission control line EML, and one driving voltage line VDDL, but the present disclosure is not necessarily limited thereto. For example, each of the pixels SP may be connected to three or more scan lines SL.

Each of the pixels SP may include at least one transistor, a light emitting element, and a capacitor.

The pixels SP may receive a driving voltage VDD through the driving voltage line VDDL. Here, the driving voltage VDD may be a high potential voltage for driving the light emitting elements of the pixels SP.

The scan lines SL and the emission control lines EML may extend in the first direction (X-axis direction) and may be spaced from each other in the second direction (Y-axis direction) crossing the first direction (X-axis direction).

The data lines DL and the driving voltage lines VDDL may extend in the second direction (Y-axis direction) and may be spaced from each other in the first direction (X-axis direction).

The non-display area NDA may be defined as the remaining area of the display panel 300 except for the display area DA. The non-display area NDA may include a scan driver 410 for applying scan signals to the scan lines SL, an emission control driver 420 for applying emission signals to the emission control lines EML, fan-out lines FL connecting the data lines DL to the display driver 310, and pads DP connected to the circuit board 320. The display driver 310 and the pads DP may be disposed in the pad area of the display panel 300. The pads DP may be disposed closer to one edge of the pad area than the display driver 310.

In FIG. 4, the display driver 310 may include a timing controller 311 and a data driver 312.

The timing controller 311 may receive digital video data DATA and timing signals from the circuit board 320. The timing controller 311 may generate a scan control signal SCS based on the timing signals to control the operation timing of the scan driver 410, generate an emission control signal ECS to control the operation timing of an emission control driver 420, and generate a data control signal DCS to control the operation timing of the data driver 312. The timing controller 311 may output the scan control signal SCS to the scan driver 410 through a first scan control line SCL1. The timing controller 311 may output the emission control signal ECS to the emission control driver 420 through a second scan control line SCL2. The timing controller 311 may output the digital video data DATA and the data control signal DCS to the data driver 312.

The data driver 312 may convert the digital video data DATA into analog data voltages and output them to the data lines DL through the fan-out lines FL. The scan signals of the scan driver 410 may select pixels SP to which the data voltage is supplied, and the selected pixels SP may receive the data voltage through the data lines DL.

In FIG. 3, the scan driver 410 may be disposed outside one side of the display area DA or on one side of the non-display area NDA. The emission control driver 420 may be disposed outside the other side of the display area DA or on the other side of the non-display area NDA. As another example, both the scan driver 410 and the emission control driver 420 may be disposed outside one side of the display area DA.

The scan driver 410 may include a plurality of thin film transistors for generating scan signals based on the scan control signal SCS, and the emission control driver 420 may include a plurality of transistors for generating emission signals based on the emission control signal ECS. For example, the transistors of the scan driver 410 and the transistors of the emission control driver 420 may be formed in the same layer as the transistors of each of the pixels SP.

Figure 5:
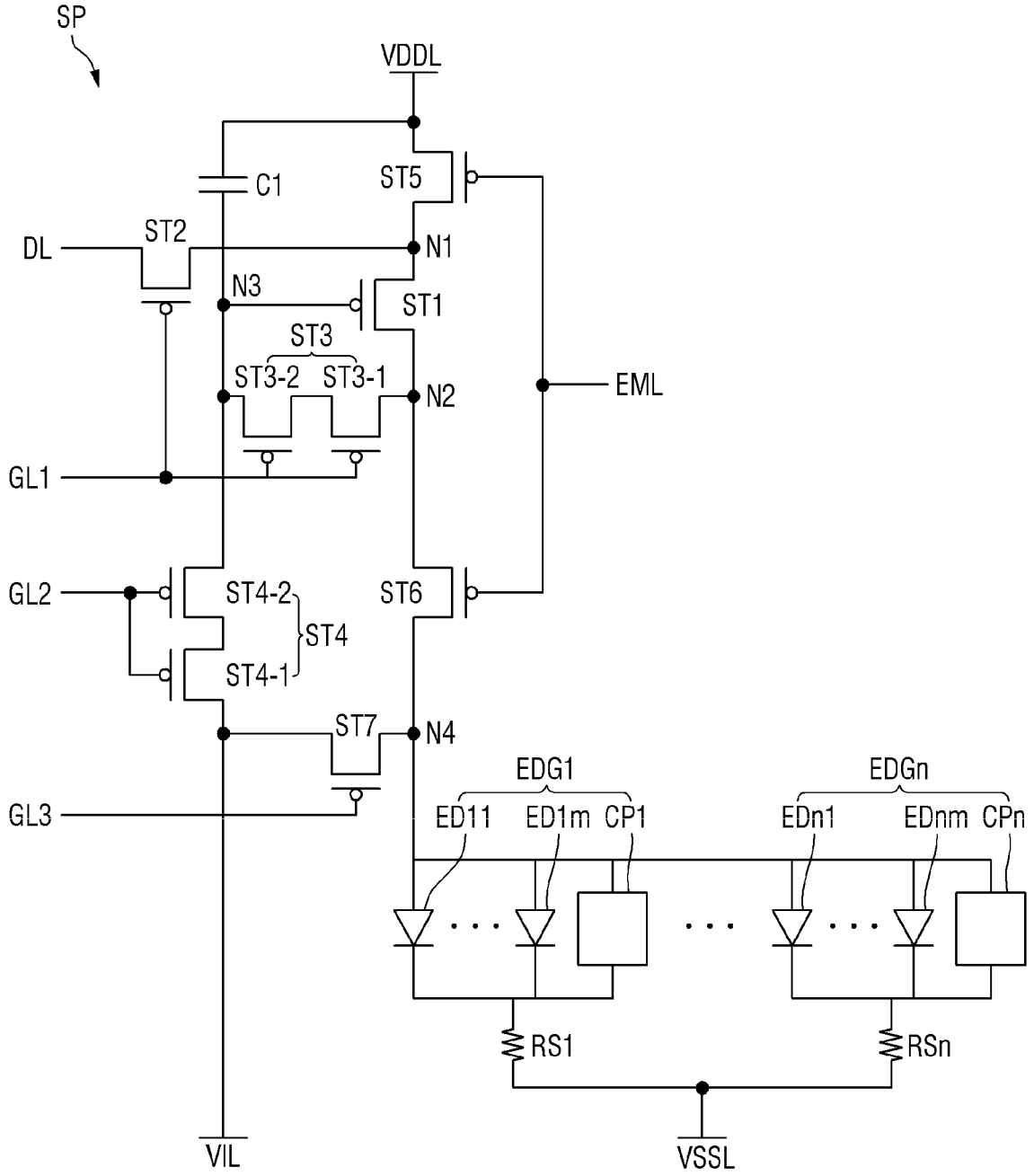
FIG. 5 is a circuit diagram illustrating a pixel of a display device according to one or more example embodiments.

FIG. 5 is a circuit diagram illustrating a pixel of a display device according to one or more example embodiments.

Referring to FIG. 5, the display panel 300 may include a plurality of pixels SP arranged along k rows (k is a natural number) and j columns (j is a natural number). Each of the plurality of pixels SP may be connected to a first gate line GL1, a second gate line GL2, a third gate line GL3, an emission control line EML, a data line DL, a driving voltage line VDDL, and an initialization voltage line VIL.

Each of the plurality of pixels SP may include a plurality of switching elements, a capacitor C1, and a plurality of light emitting groups EDG. The switching elements may include first to seventh transistors ST1, ST2, ST3, ST4, ST5, ST6, and ST7.

The first transistor ST1 may include a gate electrode, a first electrode, and a second electrode. The first electrode of the first transistor ST1 may be connected to a first node N1, the second electrode thereof may be connected to a second node N2, and the gate electrode thereof may be connected to a third node N3. The first transistor ST1 may control a source-drain current Isd (hereinafter referred to as "driving current") according to the data voltage (hereinafter, denoted by "Vdata") applied to the gate electrode of the first transistor ST1 (e.g., when the first transistor ST1 is diode-connected). For example, the first electrode of the first transistor ST1 may be a source electrode and the second electrode of the first transistor ST1 may be a drain electrode, but the present disclosure is not limited thereto.

Each of the plurality of light emitting groups EDG may include a plurality of light emitting elements ED. The light emitting elements ED may emit light by receiving the driving current Isd. The emission amount or the luminance of the light emitting element ED may be proportional to the magnitude of the driving current Isd. The light emitting element ED may be an inorganic light emitting element including a first electrode, a second electrode, and an inorganic semiconductor disposed between the first electrode and the second electrode. The first electrode of the plurality of light emitting elements ED may be connected to a fourth node N4. The first electrode of the plurality of light emitting elements ED may be connected to the second electrode of the sixth transistor ST6 and the second electrode of the seventh transistor ST7 through the fourth node N4.

The second transistor ST2 may be turned on by a gate signal (having a low-level gate on voltage) of the first gate line GL1 to connect the data line DL to the first node N1 which is the first electrode of the first transistor ST1. The second transistor ST2 may be turned on according to the gate signal of the first gate line GL1 to supply the data voltage Vdata to the first node N1. The gate electrode of the second transistor ST2 may be connected to the first gate line GL1, the first electrode thereof may be connected to the data line DL, and the second electrode thereof may be connected to the first node N1. The second electrode of the second transistor ST2 may be connected to the first electrode of the first transistor ST1 and the second electrode of the fifth transistor ST5 through the first node N1. For example, the first electrode of the second transistor ST2 may be a source electrode and the second electrode of the second transistor ST2 may be a drain electrode, but the present disclosure is not limited thereto.

The third transistor ST3 may be turned on by the gate signal (having a low-level gate on voltage) of the first gate line GL1 to connect the second node N2, which is the second electrode of the first transistor ST1, to the third node N3, which is the gate electrode of the first transistor ST1. For example, the third transistor ST3 may be a dual transistor including a third-first transistor ST3-1 and a third-second transistor ST3-2. The gate electrode of the third-first transistor ST3-1 may be connected to the first gate line GL1, the first electrode thereof may be connected to the second node N2, and the second electrode thereof may be connected to the first electrode of the third-second transistor ST3-2. The gate electrode of the third-second transistor ST3-2 may be connected to the first gate line GL1, the first electrode thereof may be connected to the second electrode of the third-first transistor ST3-1, and the second electrode thereof may be connected to the third node N3. For example, the first electrode of each of the third-first transistor ST3-1 and the third-second transistor ST3-2 may be a source electrode and the second electrode of each of the third-first transistor ST3-1 and the third-second transistor ST3-2 may be a drain electrode, but the present disclosure is not limited thereto.

The fourth transistor ST4 may be turned on by the gate signal (having a low-level gate on voltage) of the second gate line GL2 to connect the initialization voltage line VIL to the third node N3, which is the gate electrode of the first transistor ST1. For example, the fourth transistor ST4 may be a dual transistor including a fourth-first transistor ST4-1 and a fourth-second transistor ST4-2. The fourth-first transistor ST4-1 and the fourth-second transistor ST4-2 may be turned on based on the gate signal of the second gate line GL2, thereby discharging the gate electrode of the first transistor ST1 to the initialization voltage VI. The gate electrode of the fourth-first transistor ST4-1 may be connected to the second gate line GL2, the first electrode thereof may be connected to the initialization voltage line VIL, and the second electrode thereof may be connected to the first electrode of the fourth-second transistor ST4-2. The gate electrode of the fourth-second transistor ST4-2 may be connected to the second gate line GL2, the first electrode thereof may be connected to the second electrode of the fourth-first transistor ST4-1, and the second electrode thereof may be connected to the third node N3. For example, the first electrode of each of the fourth-first transistor ST4-1 and the fourth-second transistor ST4-2 may be a source electrode and the second electrode may be a drain electrode, but the present disclosure is not limited thereto.

The fifth transistor ST5 may be turned on by the emission signal of the emission control line EML to connect the driving voltage line VDDL to the first node N1, which is the first electrode of the first transistor ST1. The gate electrode of the fifth transistor ST5 may be connected to the emission control line EML, the first electrode thereof may be connected to the driving voltage line VDDL, and the second electrode thereof may be connected to the first node N1. The second electrode of the fifth transistor ST5 may be connected to the first electrode of the first transistor ST1 and the second electrode of the second transistor ST2 through the first node N1. For example, the first electrode of the fifth transistor ST5 may be a source electrode and the second electrode of the fifth transistor ST5 may be a drain electrode, but the present disclosure is not limited thereto.

The sixth transistor ST6 may be turned on by the emission signal of the emission control line EML to connect the second node N2, which is the second electrode of the first transistor ST1, to the fourth node N4, which is the first electrode of the plurality of light emitting elements ED. The gate electrode of the sixth transistor ST6 may be connected to the emission control line EML, the first electrode thereof may be connected to the second node N2, and the second electrode thereof may be connected to the fourth node N4. The first electrode of the sixth transistor ST6 may be connected to the second electrode of the first transistor ST1 and the first electrode of the third-first transistor ST3-1 through the second node N2. The second electrode of the sixth transistor ST6 may be connected to the first electrode of the plurality of light emitting elements ED and the second electrode of the seventh transistor ST7 through the fourth node N4. For example, the first electrode of the sixth transistor ST6 may be a source electrode and the second electrode of the sixth transistor ST6 may be a drain electrode, but the present disclosure is not limited thereto.

The fifth transistor ST5 and the sixth transistor ST6 may be turned off when a gate off voltage (e.g., a high-level voltage) is supplied at the gate electrodes of the fifth transistor ST5 and the sixth transistor ST6 via the emission control line EML. The fifth transistor ST5 and the sixth transistor ST6 may be turned on when a gate on voltage (e.g., a low-level voltage) is applied to their respective gate electrodes.

When all of the fifth transistor ST5, the first transistor ST1, and the sixth transistor ST6 are turned on, the driving current may be supplied to the plurality of light emitting elements ED.

The seventh transistor ST7 may be turned on by the gate signal (having a low-level gate on voltage) of the third gate line GL3 to connect the initialization voltage line VIL to the fourth node N4, which is the first electrode of the plurality of light emitting elements ED. The seventh transistor ST7 may be turned on based on the gate signal, thereby discharging the first electrode of the light emitting element ED to the initialization voltage VI. The gate electrode of the seventh transistor ST7 may be connected to the third gate line GL3, the first electrode thereof may be connected to the initialization voltage line VIL, and the second electrode thereof may be connected to the fourth node N4. The second electrode of the seventh transistor ST7 may be connected to the first electrode of the plurality of light emitting elements ED and the second electrode of the sixth transistor ST6 through the fourth node N4. For example, the first electrode may be a source electrode and the second electrode may be a drain electrode, but the present disclosure is not limited thereto.

Each of the first to seventh transistors ST1 to ST7 may include a silicon-based active layer. For example, each of the first to seventh transistors ST1 to ST7 may include an active layer made of low-temperature polycrystalline silicon (LTPS). The active layer made of low-temperature polycrystalline silicon may have high electron mobility and excellent turn-on characteristics. Accordingly, the display device 10 includes the first to seventh transistors ST1 to ST7 having excellent turn-on characteristics, thereby stably and efficiently driving the plurality of pixels SP.

Each of the first to seventh transistors ST1 to ST7 may be a p-type transistor, but is not limited thereto. For example, each of the first to seventh transistors ST1 to ST7 may output a current flowing through the first electrode to the second electrode based on the gate low voltage applied to the gate electrode. In another example, at least one of the first to seventh transistors ST1 to ST7 may be an n-type transistor. Those with ordinary skill in the art would appreciate that the physical circuit layout as well as types (e.g., polarities) of applied signals would be changed in a suitable manner when one or more n-type transistors are used.

The capacitor C1 may be connected between the third node N3, which is the gate electrode of the first transistor ST1, and the driving voltage line VDDL. For example, the first electrode of the capacitor C1 may be connected to the third node N3, and the second electrode of the capacitor C1 may be connected to the driving voltage line VDDL, thereby maintaining the potential difference between the driving voltage line VDDL and the gate electrode of the first transistor ST1.

Each of the plurality of light emitting groups EDG may include a plurality of light emitting elements ED and a bypass unit CP. The plurality of light emitting elements ED of the plurality of light emitting groups EDG may share one first electrode, and each of the plurality of light emitting groups EDG may include a corresponding second electrode. The plurality of light emitting elements ED of one light emitting group EDG may share one second electrode. One end of the bypass unit CP may be connected to the fourth node N4, and the other end of the bypass unit CP may be connected to the second electrode of the corresponding light emitting group EDG. Accordingly, the plurality of light emitting elements ED and the bypass unit CP of one light emitting group EDG may be connected in parallel. The second electrode of each of the plurality of light emitting groups EDG may be connected to a low potential line VSSL through a cathode resistance element RS.

The plurality of light emitting groups EDG may include first to $n^{th}$ light emitting groups EDG1 to EDGn (n is a natural number of 2 or more). The first light emitting group EDG1 may include first to $m^{th}$ light emitting elements ED11 to ED1*m* and a first bypass unit CP1. The first to $m^{th}$ light emitting elements ED11 to ED1*m* of the first light emitting group EDG1 and the first bypass unit CP1 may be connected in parallel. The $n^{th}$ light emitting group EDGn may include first to $m^{th}$ light emitting elements EDn1 to EDnm and a bypass unit CPn. The first to $m^{th}$ light emitting elements EDn1 to EDnm and the bypass unit CPn of the $n^{th}$ light emitting group EDGn may be connected in parallel. Here, the number of light emitting elements ED of each of the first to $n^{th}$ light emitting groups EDG1 to EDGn may be randomly determined.

The first light emitting group EDG1 and the $n^{th}$ light emitting group EDGn may be connected to the fourth node N4 while sharing one first electrode. The first light emitting group EDG1 and the $n^{th}$ light emitting group EDGn may include different second electrodes, and each of the first light emitting group EDG1 and the $n^{th}$ light emitting group EDGn may be connected to the low potential line VSSL through a corresponding one of the cathode resistance elements RS1 through RSn.

Figure 6:
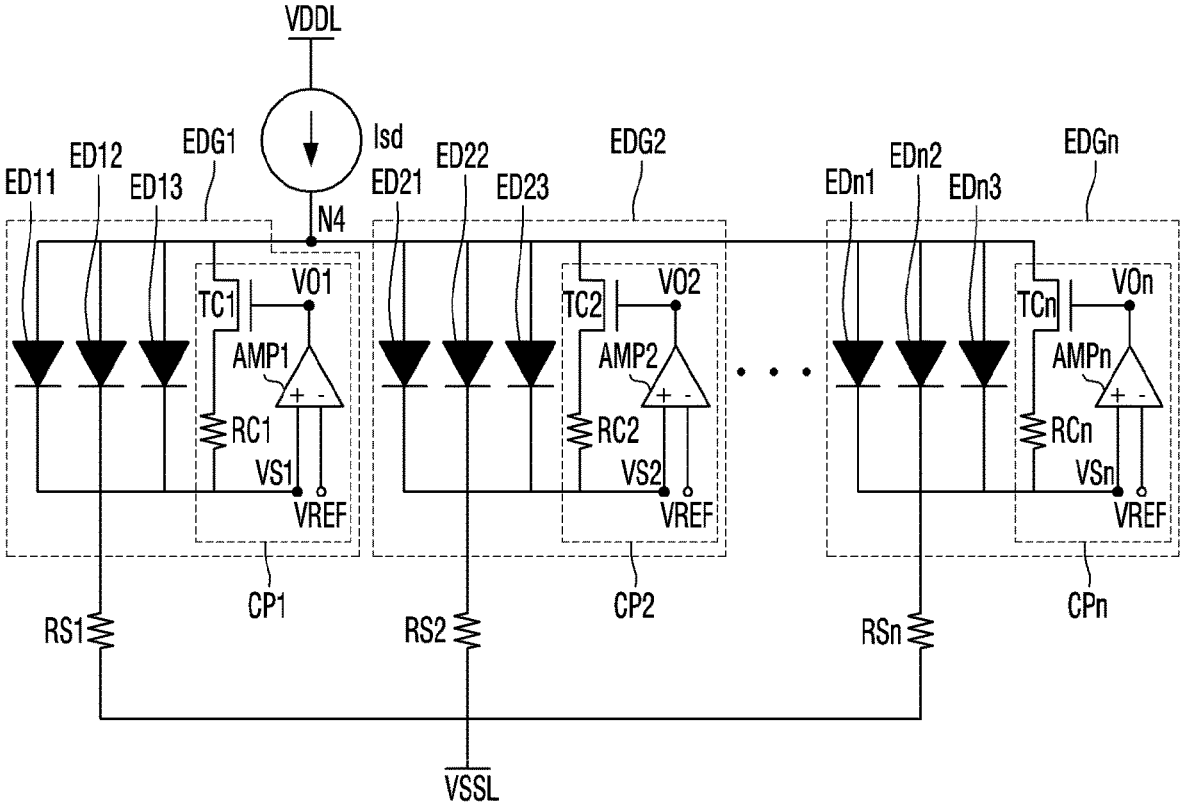
FIG. 6 is a circuit diagram showing a plurality of light emitting groups of pixels in a display device according to one or more example embodiments.
Figure 7:
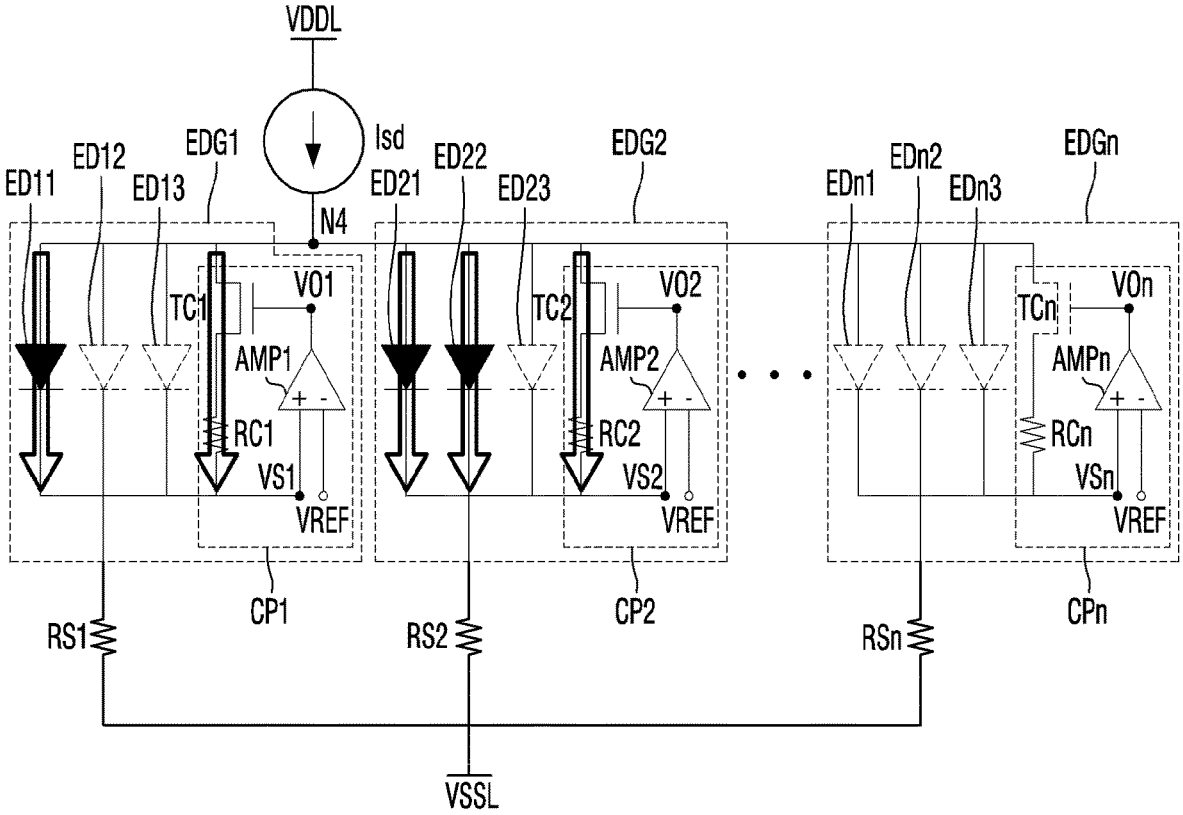
FIG. 7 is a circuit diagram showing the operation of the plurality of light emitting groups of FIG. 6.

FIG. 6 is a circuit diagram showing a plurality of light emitting groups of pixels in a display device according to one or more example embodiments. FIG. 7 is a circuit diagram showing the operation of the plurality of light emitting groups of FIG. 6.

Referring to FIGS. 6 and 7, the plurality of light emitting groups EDG may include first to $n^{th}$ light emitting groups EDG1 to EDGn (n is a natural number of 2 or more). Hereinafter, an example in which each of the plurality of light emitting groups EDG includes three light emitting elements ED will be provided, but the number of light emitting elements ED of each of the plurality of light emitting groups EDG is not limited thereto. The plurality of light emitting elements ED of the plurality of light emitting groups EDG may share one first electrode, and each of the plurality of light emitting groups EDG may include a corresponding second electrode.

The first light emitting group EDG1 may include first to third light emitting elements ED11 to ED13 and a first bypass unit CP1. The first to third light emitting elements ED11 to ED13 of the first light emitting group EDG1 and the first bypass unit CP1 may be connected in parallel. One end of the first bypass unit CP1 may be connected to the first electrode of the first to third light emitting elements ED11 to ED13, and the other end of the first bypass unit CP1 may be connected to the second electrode of the first to third light emitting elements ED11 to ED13.

The first bypass unit CP1 may include an amplifier AMP1, a compensation transistor TC1 and a bypass resistance element RC1.

The amplifier AMP1 may compare a voltage VS1 of the second electrode of the first light emitting group EDG1 with a reference voltage VREF and supply an output voltage VO1 to the gate electrode of the compensation transistor TC1. For example, a part of the driving current Isd may be supplied to the first electrode of the first to third light emitting elements ED11 to ED13 through the fourth node N4, and the first to third light emitting elements ED11 to ED13 may receive the part of the driving current Isd to emit light. When a part of the driving current Isd passes through the first to third light emitting elements ED11 to ED13, the second electrode of the first light emitting group EDG1 may have a voltage (e.g., a predetermined voltage) VS1. The voltage VS1 at the second electrode of the first light emitting group EDG1 may be supplied to a first input terminal of the amplifier AMP1, and the reference voltage VREF may be supplied to a second input terminal of the amplifier AMP1. When the voltage VS1 of the second electrode of the first light emitting group EDG1 is greater than the reference voltage VREF, the amplifier AMP1 may amplify the voltage difference between the voltage VS1 of the second electrode and the reference voltage VREF and then output the same. When the voltage VS1 of the second electrode of the first light emitting group EDG1 is greater than the reference voltage VREF, the output voltage VO1 of the amplifier AMP1 may correspond to a gate-on voltage capable of turning on the compensation transistor TC1.

The compensation transistor TC1 may allow a part of the driving current Isd to pass therethrough based on the output voltage VO1 of the amplifier AMP1. The gate electrode of the compensation transistor TC1 may be connected to the output terminal of the amplifier AMP1, the first electrode of the compensation transistor TC1 may be connected to the first electrode of the first light emitting group EDG1, and the second electrode of the compensation transistor TC1 may be connected to one end of a bypass resistance element RC1. When the output voltage VO1 of the amplifier AMP1 is greater than the gate-on voltage, the compensation transistor TC1 may be turned on, thereby allowing a part of the driving current Isd to pass therethrough. When the output voltage VO1 of the amplifier AMP1 does not reach the gate-on voltage, the compensation transistor TC1 may be turned off, thereby blocking the flow of the driving current Isd through the compensation transistor TC1. The part of the driving current Isd passing through the compensation transistor TC1 may be supplied to the bypass resistance element RC1.

The bypass resistance element RC1 may be connected in series with the compensation transistor TC1. One end of the bypass resistance element RC1 may be connected to the second electrode of the compensation transistor TC1, and the other end of the bypass resistance element RC1 may be connected to the second electrode of the first light emitting group EDG1. The bypass resistance element RC1 may correspond to a conductive pattern having a resistance value (e.g., a predetermined resistance value). When a part of the driving current Isd flows through the compensation transistor TC1, the bypass resistance element RC1 may decrease the voltage of the second electrode of the compensation transistor TC1.

In some embodiments, the bypass resistance element RC1 may be omitted. When the bypass resistance element RC1 is omitted, a connection electrode between the second electrode of the compensation transistor TC1 and the second electrode of the first light emitting group EDG1 may serve as a bypass resistance element.

The second electrode of the first light emitting group EDG1 may be connected to the low potential line VSSL through the cathode resistance element RS1. The cathode resistance element RS1 may correspond to a conductive pattern having a resistance value (e.g., a predetermined resistance value). Accordingly, a part of the driving current Isd having passed through the first to third light emitting elements ED11 to ED13 or the first bypass unit CP1 may flow through the cathode resistance element RS1 to the low potential line VSSL.

The second light emitting group EDG2 may include first to third light emitting elements ED21 to ED23 and a second bypass unit CP2, and the $n^{th}$ light emitting group EDGn may include first to third light emitting elements EDn1 to EDn3 and an $n^{th}$ bypass unit CPn. Here, the number of light emitting elements ED of each of the first to $n^{th}$ light emitting groups EDG1 to EDGn may be the same or different. The first to $n^{th}$ bypass units CP1 to CPn of each of the first to $n^{th}$ light emitting groups EDG1 to EDGn may have a substantially identical configuration. Therefore, the first to $n^{th}$ light emitting groups EDG1 to EDGn may have an identical configuration except for the number of light emitting elements ED.

In FIG. 7, the first light emitting element ED11 of the first light emitting group EDG1 becomes conductive and thus the driving current Isd passes therethrough, and the second and third light emitting elements ED12 and ED13 does not become conductive and thus the driving current Isd cannot pass therethrough. Here, when each of first and second semiconductor portions of the light emitting element ED is connected to each of the first electrode and the second electrode of the light emitting group EDG, the light emitting element ED is conductive and thus the driving current Isd can pass therethrough. In addition, whether or not the light emitting element ED shown in FIG. 7 is conductive is given merely for description of the embodiment, and the present disclosure is not limited thereto.

The first and second light emitting elements ED21 and ED22 of the second light emitting group EDG2 are conductive and thus the driving current Isd can pass therethrough, and the third light emitting element ED23 thereof is not conductive and thus the driving current Isd cannot pass therethrough. All of the first to third light emitting elements EDn1 to EDn3 of the $n^{th}$ light emitting group EDGn are non-conductive, and thus the driving current Isd cannot pass therethrough. In this case, because the driving current Isd cannot pass through any of the first to third light emitting elements EDn1 to EDn3 of the $n^{th}$ light emitting group EDGn, the voltage VSn of the second electrode of the $n^{th}$ light emitting group EDGn may be smaller than the reference voltage VREF, and the compensation transistor TCn may be turned off. Accordingly, the driving current Isd may flow through the first and second light emitting groups EDG1 and EDG2 but not through the $n^{th}$ light emitting group EDGn.

When the $n^{th}$ light emitting group EDGn is electrically opened and the driving current Isd does not pass therethrough, the first and second light emitting groups EDG1 and EDG2 can receive higher driving current Isd than in the case of the $n^{th}$ light emitting group EDGn. In this case, the first bypass unit CP1 of the first light emitting group EDG1 and the second bypass unit CP2 of the second light emitting group EDG2 bypass a part of the driving current Isd, thereby distributing the current Isd flowing through the light emitting elements ED. Accordingly, the first and second bypass units CP1 and CP2 can distribute the driving current Isd flowing through the light emitting elements ED based on the cathode voltages VS1 and VS2 of the first and second light emitting groups EDG1 and EDG2, respectively.

Because the display device 10 includes the respective bypass unit CP connected in parallel with the plurality of light emitting elements ED of each of the plurality of light emitting groups EDG, even when some of the plurality of light emitting groups EDG do not allow the driving current Isd to pass therethrough, it is possible to distribute the driving current Isd flowing through light emitting elements ED of the other light emitting groups EDG. Therefore, the display device 10 can prevent an overcurrent from flowing through the light emitting element ED, thereby preventing the hotspot phenomenon of the light emitting element ED and the deterioration of the light emitting element ED.

Figure 8:
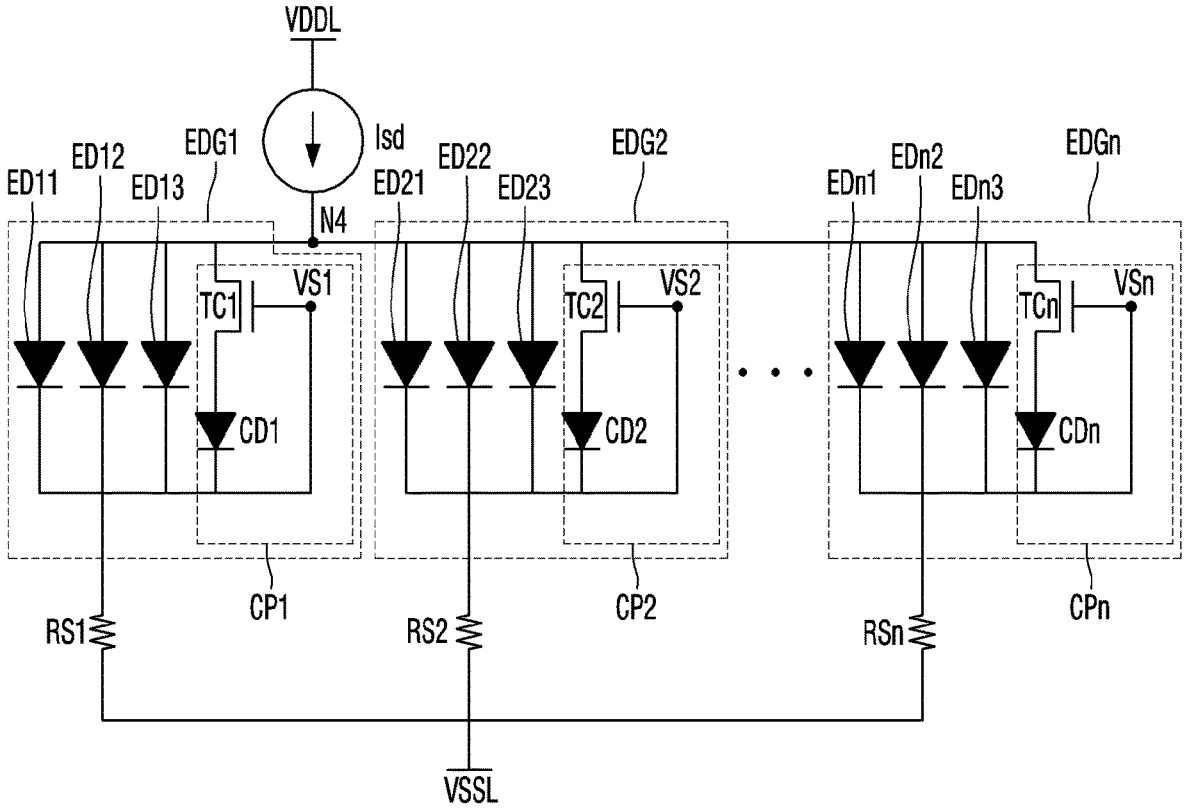
FIG. 8 is a circuit diagram showing a plurality of light emitting groups of pixels in a display device according to another example embodiment.
Figure 9:
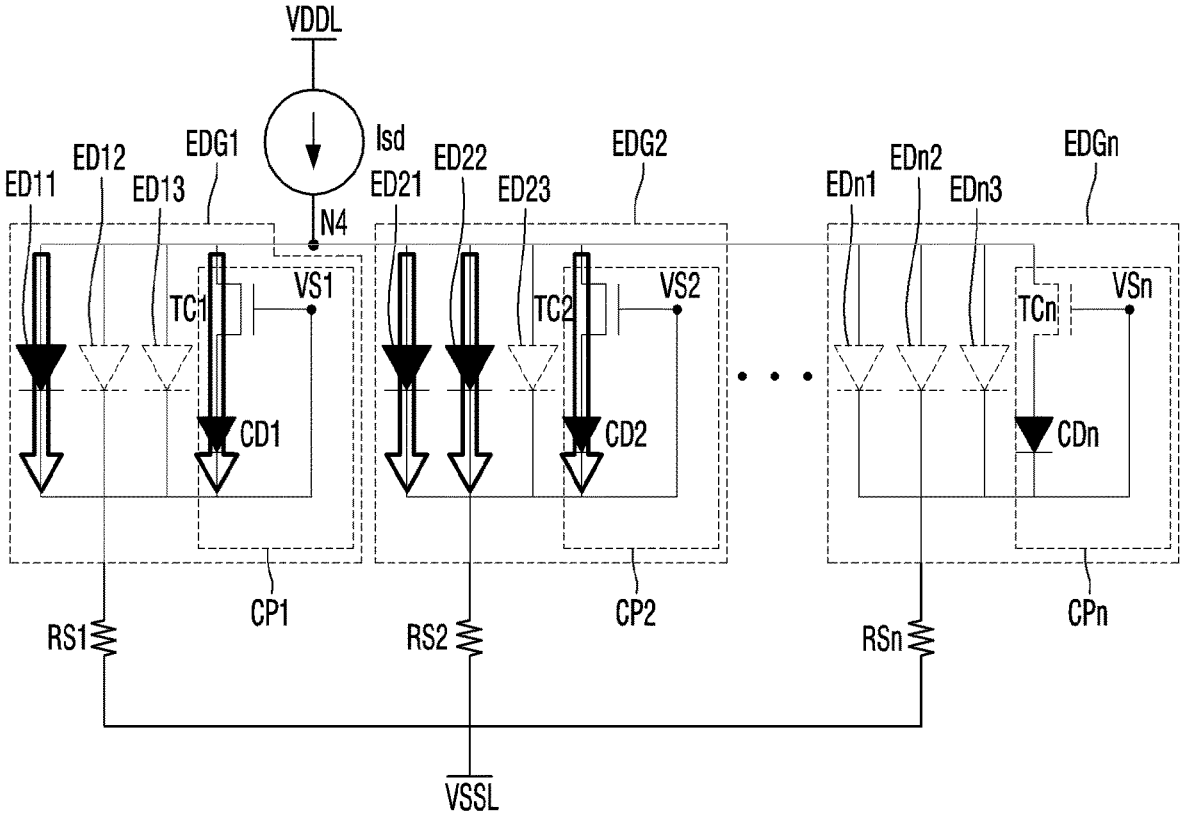
FIG. 9 is a circuit diagram showing the operation of the plurality of light emitting groups of FIG. 8.

FIG. 8 is a circuit diagram showing a plurality of light emitting groups of pixels in a display device according to another example embodiment. FIG. 9 is a circuit diagram showing the operation of the plurality of light emitting groups of FIG. 8. The display devices of FIGS. 8 and 9 have different bypass unit CP configurations from those of the display devices of FIGS. 6 and 7, and configurations the same as those described above will be described briefly, or a description thereof will be omitted.

Referring to 8 and 9, the plurality of light emitting groups EDG may include first to $n^{th}$ light emitting groups EDG1 to EDGn (n is a natural number of 2 or more). The plurality of light emitting elements ED of the plurality of light emitting groups EDG may share one first electrode, and each of the plurality of light emitting groups EDG may include a corresponding second electrode.

The first light emitting group EDG1 may include first to third light emitting elements ED11 to ED13 and a first bypass unit CP1. The first to third light emitting elements ED11 to ED13 and the first bypass unit CP1 of the first light emitting group EDG1 may be connected in parallel. One end of the first bypass unit CP1 may be connected to the first electrode of the first to third light emitting elements ED11 to ED13, and the other end of the first bypass unit CP1 may be connected to the second electrode of the first to third light emitting elements ED11 to ED13.

The first bypass unit CP1 may include a compensation transistor TC1 and a compensation diode CD1.

The compensation transistor TC1 may allow a part of the driving current Isd to pass therethrough based on the voltage VS1 of the second electrode of the first light emitting group EDG1. The gate electrode of the compensation transistor TC1 may be connected to the second electrode of the first light emitting group EDG1, the first electrode of the compensation transistor TC1 may be connected to the first electrode of the first light emitting group EDG1, and the second electrode of the compensation transistor TC1 may be connected to one end of the compensation diode CD1. When the voltage VS1 of the second electrode of the first light emitting group EDG1 is greater than the gate-on voltage, the compensation transistor TC1 may be turned on, thereby allowing a part of the driving current Isd to pass therethrough. When the voltage VS1 of the second electrode of the first light emitting group EDG1 does not reach the gate-on voltage, the compensation transistor TC1 may be turned off, thereby blocking the flow of the driving current Isd. The part of the driving current Isd having passed through the compensation transistor TC1 may be supplied to the bypass resistance element RC1 (see, for example, FIG. 6).

The compensation diode CD1 may be connected in series with the compensation transistor TC1. One end of the compensation diode CD1 may be connected to the second electrode of the compensation transistor TC1, and the other end of the compensation diode CD1 may be connected to the second electrode of the first light emitting group EDG1. When a part of the driving current Isd flows through the compensation transistor TC1, the compensation diode CD1 may decrease the voltage of the second electrode of the compensation transistor TC1. For example, the compensation diode CD1 may be a non-light emitting diode. Therefore, when a part of the driving current Isd flows through the compensation diode CD1, the compensation diode CD1 may not emit light.

The second electrode of the first light emitting group EDG1 may be connected to the low potential line VSSL through the cathode resistance element RS1. The cathode resistance element RS1 may correspond to a conductive pattern having a resistance value (e.g., a predetermined resistance value). Accordingly, a part of the driving current Isd having passed through the first to third light emitting elements ED11 to ED13 or the first bypass unit CP1 may flow through the cathode resistance element RS1 to the low potential line VSSL.

The second light emitting group EDG2 may include first to third light emitting elements ED21 to ED23 and a second bypass unit CP2, and the $n^{th}$ light emitting group EDGn may include first to third light emitting elements EDn1 to EDn3 and an $n^{th}$ bypass unit CPn.

In FIG. 9, the first light emitting element ED11 of the first light emitting group EDG1 becomes conductive and thus the driving current Isd can pass therethrough, and the second and third light emitting elements ED12 and ED13 do not become conductive and thus the driving current Isd cannot pass therethrough. In addition, whether or not the light emitting element ED shown in FIG. 9 is conductive is given for description of the embodiment, and the present disclosure is not limited thereto.

The first and second light emitting elements ED21 and ED22 of the second light emitting group EDG2 are conductive and thus the driving current Isd can pass therethrough, and the third light emitting element ED23 thereof is not conductive and thus the driving current Isd cannot pass therethrough. All of the first to third light emitting elements EDn1 to EDn3 of the $n^{th}$ light emitting group EDGn are not conductive and thus the driving current Isd cannot pass therethrough. In this case, because the driving current Isd cannot pass through any of the first to third light emitting elements EDn1 to EDn3 of the $n^{th}$ light emitting group EDGn, the voltage VSn of the second electrode of the $n^{th}$ light emitting group EDGn may be smaller than the gate-on voltage, and the compensation transistor TCn may be turned off. Accordingly, the driving current Isd may flow through the first and second light emitting groups EDG1 and EDG2 excluding the $n^{th}$ light emitting group EDGn.

When the $n^{th}$ light emitting group EDGn is electrically opened and the driving current Isd does not pass therethrough, the first and second light emitting groups EDG1 and EDG2 can receive higher driving current Isd than in the case of the $n^{th}$ light emitting group EDGn. In this case, the first bypass unit CP1 of the first light emitting group EDG1 and the second bypass unit CP2 of the second light emitting group EDG2 bypass a part of the driving current Isd, thereby distributing the current Isd flowing through the light emitting elements ED. Accordingly, the first and second bypass units CP1 and CP2 can distribute the driving current Isd flowing through the light emitting elements ED based on the cathode voltages VS1 and VS2 of the first and second light emitting groups EDG1 and EDG2, respectively.

Because the display device 10 includes the bypass unit CP connected in parallel with the plurality of light emitting elements ED of each of the plurality of light emitting groups EDG, even when some of the plurality of light emitting groups EDG do not allow the driving current Isd to pass therethrough, it is possible to distribute the driving current Isd flowing through light emitting elements ED of the other light emitting groups EDG. Therefore, the display device 10 can prevent an overcurrent from flowing through the light emitting element ED, thereby preventing the hotspot phenomenon of the light emitting element ED and the deterioration of the light emitting element ED.

Figure 10:
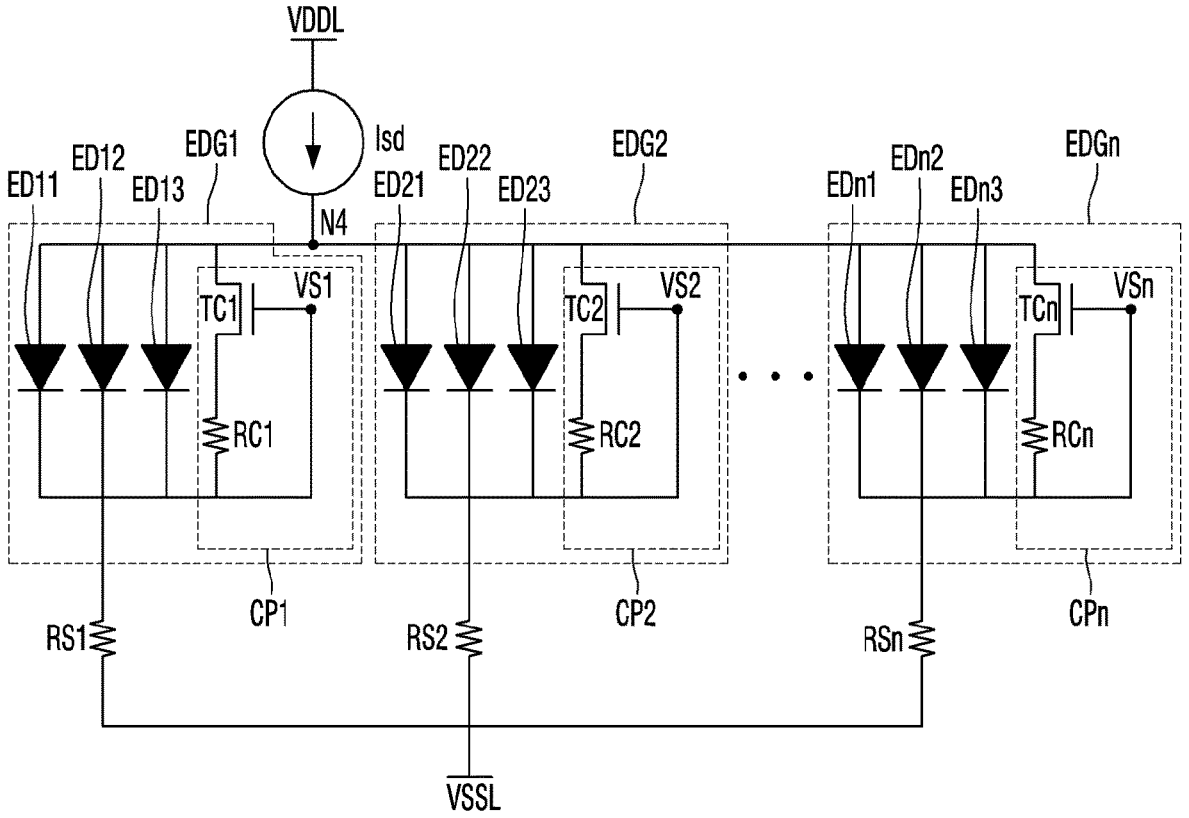
FIG. 10 is a circuit diagram showing a plurality of light emitting groups of pixels in a display device according to yet another example embodiment.
Figure 11:
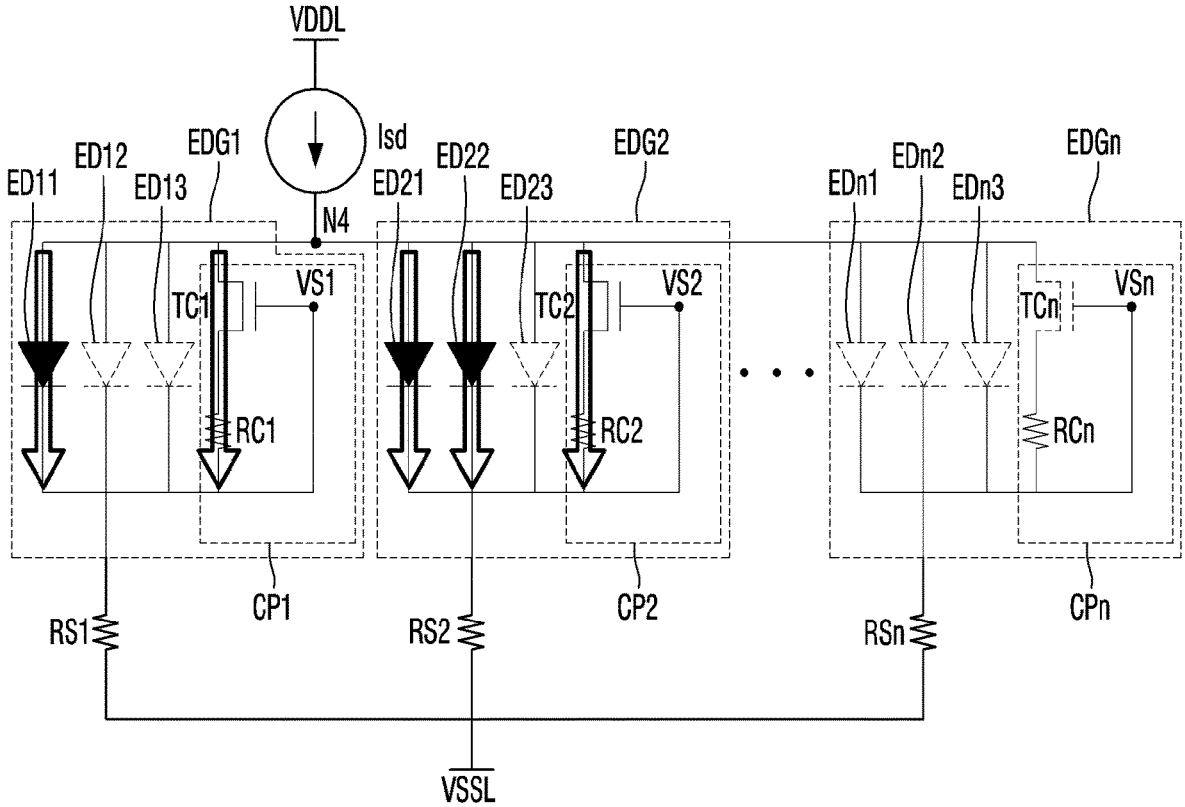
FIG. 11 is a circuit diagram showing the operation of the plurality of light emitting groups of FIG. 10.

FIG. 10 is a circuit diagram showing a plurality of light emitting groups of pixels in a display device according to yet another example embodiment. FIG. 11 is a circuit diagram showing the operation of the plurality of light emitting groups of FIG. 10.

Referring to FIGS. 10 and 11, the plurality of light emitting groups EDG may include first to $n^{th}$ light emitting groups EDG1 to EDGn (n is a natural number of 2 or more). The plurality of light emitting elements ED of the plurality of light emitting groups EDG may share one first electrode, and each of the plurality of light emitting groups EDG may include a corresponding second electrode.

The first light emitting group EDG1 may include first to third light emitting elements ED11 to ED13 and a first bypass unit CP1. The first to third light emitting elements ED11 to ED13 and the first bypass unit CP1 of the first light emitting group EDG1 may be connected in parallel. One end of the first bypass unit CP1 may be connected to the first electrode of the first to third light emitting elements ED11 to ED13, and the other end of the first bypass unit CP1 may be connected to the second electrode of the first to third light emitting elements ED11 to ED13.

The first bypass unit CP1 may include a compensation transistor TC1 and a bypass resistance element RC1.

The compensation transistor TC1 may allow a part of the driving current Isd to pass therethrough based on the voltage VS1 of the second electrode of the first light emitting group EDG1. The gate electrode of the compensation transistor TC1 may be connected to the second electrode of the first light emitting group EDG1, the first electrode of the compensation transistor TC1 may be connected to the first electrode of the first light emitting group EDG1, and the second electrode of the compensation transistor TC1 may be connected to one end of the bypass resistance element RC1. When the voltage VS1 of the second electrode of the first light emitting group EDG1 is greater than the gate-on voltage of the compensation transistor TC1, the compensation transistor TC1 may be turned on, thereby allowing a part of the driving current Isd to pass therethrough. When the voltage VS1 of the second electrode of the first light emitting group EDG1 does not reach the gate-on voltage, the compensation transistor TC1 may be turned off, thereby blocking the flow of the driving current Isd therethrough. The part of the driving current Isd having passed through the compensation transistor TC1 may be supplied to the bypass resistance element RC1.

The bypass resistance element RC1 may be connected in series with the compensation transistor TC1. One end of the bypass resistance element RC1 may be connected to the second electrode of the compensation transistor TC1, and the other end of the bypass resistance element RC1 may be connected to the second electrode of the first light emitting group EDG1. The bypass resistance element RC1 may correspond to a conductive pattern having a resistance value (e.g., a predetermined resistance value). When a part of the driving current Isd flows through the bypass resistance element RC1, the bypass resistance element RC1 may decrease the voltage of the second electrode of the compensation transistor TC1.

In some embodiments, the bypass resistance element RC1 may be omitted. When the bypass resistance element RC1 is omitted, a connection electrode between the second electrode of the compensation transistor TC1 and the second electrode of the first light emitting group EDG1 may serve as the bypass resistance element.

The second electrode of the first light emitting group EDG1 may be connected to the low potential line VSSL through the cathode resistance element RS1. The cathode resistance element RS1 may correspond to a conductive pattern having a resistance value (e.g., a predetermined resistance value). Accordingly, a part of the driving current Isd having passed through the first to third light emitting elements ED11 to ED13 or the first bypass unit CP1 may flow through the cathode resistance element RS1 to the low potential line VSSL.

The second light emitting group EDG2 may include first to third light emitting elements ED21 to ED23 and a second bypass unit CP2, and the $n^{th}$ light emitting group EDGn may include first to third light emitting element EDn1 to EDn3 and an $n^{th}$ bypass unit CPn.

In FIG. 11, the first light emitting element ED11 of the first light emitting group EDG1 becomes conductive and thus the driving current Isd can pass therethrough, and the second and third light emitting elements ED12 and ED13 do not become conductive, and thus the driving current Isd cannot pass therethrough. Here, when each of the first and second semiconductor portions of the light emitting element ED is connected normally to each of the first electrode and the second electrode of the light emitting group EDG, the light emitting element ED is conductive and thus the driving current Isd can pass therethrough. In addition, whether or not the light emitting element ED shown in FIG. 11 is conductive is given only for description of the embodiment, and the present disclosure is not limited thereto.

The first and second light emitting elements ED21 and ED22 of the second light emitting group EDG2 are conductive and thus the driving current Isd can pass therethrough, and the third light emitting element ED23 thereof is not conductive and thus the driving current Isd cannot pass therethrough. All of the first to third light emitting elements EDn1 to EDn3 of the $n^{th}$ light emitting group EDGn are non-conductive, and thus the driving current Isd cannot pass therethrough. In this case, because the driving current Isd cannot pass through any of the first to third light emitting elements EDn1 to EDn3 of the $n^{th}$ light emitting group EDGn, the voltage VSn of the second electrode of the $n^{th}$ light emitting group EDGn may be smaller than the reference voltage VREF, and the compensation transistor TCn may be turned off. Accordingly, the driving current Isd may flow through the first and second light emitting groups EDG1 and EDG2 excluding the $n^{th}$ light emitting group EDGn.

When the $n^{th}$ light emitting group EDGn is electrically opened and the driving current Isd does not pass therethrough, the first and second light emitting groups EDG1 and EDG2 can receive higher driving current Isd than in the case of the $n^{th}$ light emitting group EDGn. In this case, the first bypass unit CP1 of the first light emitting group EDG1 and the second bypass unit CP2 of the second light emitting group EDG2 bypass a part of the driving current Isd, thereby distributing the current Isd flowing through the light emitting elements ED. Accordingly, the first and second bypass units CP1 and CP2 can distribute the driving current Isd flowing through the light emitting elements ED based on the cathode voltages VS1 and VS2 of the first and second light emitting groups EDG1 and EDG2, respectively.

Because the display device 10 includes the bypass unit CP connected in parallel with the plurality of light emitting elements ED of each of the plurality of light emitting groups EDG, even when some of the plurality of light emitting groups EDG do not allow the driving current Isd to pass therethrough, it is possible to distribute the driving current Isd flowing through light emitting elements ED of the other light emitting groups EDG. Therefore, the display device 10 can prevent an overcurrent from flowing through the light emitting element ED, thereby preventing the hotspot phenomenon of the light emitting element ED and deterioration of the light emitting element ED.

Figure 12:
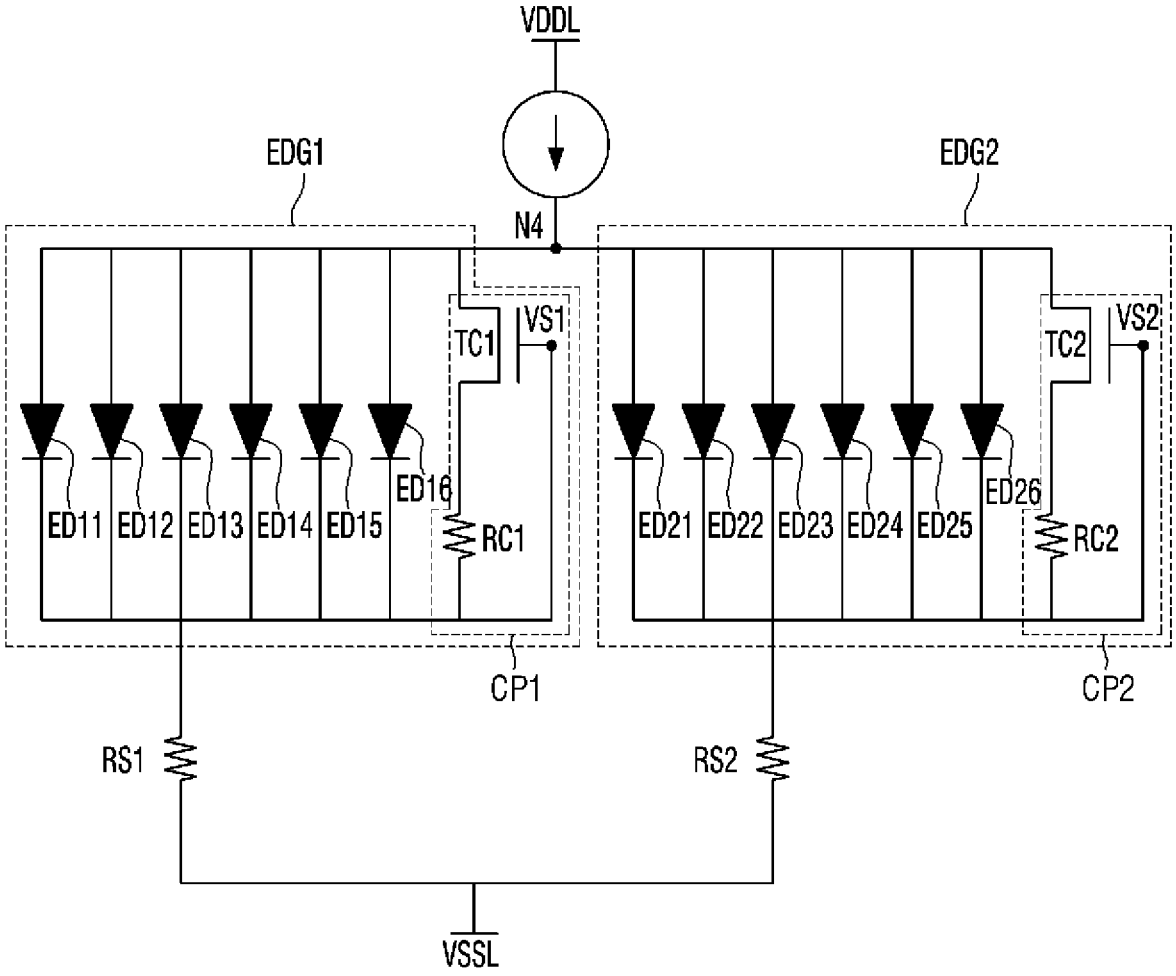
FIG. 12 is a circuit diagram showing a plurality of light emitting groups of pixels in a display device according to yet another example embodiment.

FIG. 12 is a circuit diagram showing a plurality of light emitting groups of pixels in a display device according to yet another example embodiment.

Referring to FIG. 12, the plurality of light emitting groups EDG may include first and second light emitting groups EDG1 and EDG2. The plurality of light emitting elements ED of the first and second light emitting groups EDG1 and EDG2 may share one first electrode, and each of the first and second light emitting groups EDG1 and EDG2 may include a corresponding second electrode.

The first light emitting group EDG1 may include first to sixth light emitting elements ED11 to ED16 and a first bypass unit CP1. The first to sixth light emitting elements ED11 to ED16 and the first bypass unit CP1 of the first light emitting group EDG1 may be connected in parallel. One end of the first bypass unit CP1 may be connected to the first electrode of the first to sixth light emitting elements ED11 to ED16, and the other end of the first bypass unit CP1 may be connected to the second electrode of the first to sixth light emitting elements ED11 to ED16.

The first bypass unit CP1 may include a compensation transistor TC1 and a bypass resistance element RC1.

The compensation transistor TC1 may allow a part of the driving current Isd to pass therethrough based on the voltage VS1 of the second electrode of the first light emitting group EDG1. The gate electrode of the compensation transistor TC1 may be connected to the second electrode of the first light emitting group EDG1, the first electrode of the compensation transistor TC1 may be connected to the first electrode of the first light emitting group EDG1, and the second electrode of the compensation transistor TC1 may be connected to one end of the bypass resistance element RC1. The part of the driving current Isd having passed through the compensation transistor TC1 may be supplied to the bypass resistance element RC1.

The bypass resistance element RC1 may be connected in series with the compensation transistor TC1. One end of the bypass resistance element RC1 may be connected to the second electrode of the compensation transistor TC1, and the other end of the bypass resistance element RC1 may be connected to the second electrode of the first light emitting group EDG1. When a part of the driving current Isd flows through the compensation transistor TC1, the bypass resistance element RC1 may decrease the voltage of the second electrode of the compensation transistor TC1.

The second electrode of the first light emitting group EDG1 may be connected to the low potential line VSSL through the cathode resistance element RS1. The cathode resistance element RS1 may correspond to a conductive pattern having a resistance value (e.g., a predetermined resistance value). Accordingly, a part of the driving current Isd having passed through the first to sixth light emitting elements ED11 to ED16 or the first bypass unit CP1 of the first light emitting group EDG1 may flow through the cathode resistance element RS1 to the low potential line VSSL.

The second light emitting group EDG2 may include first to sixth light emitting elements ED21 to ED26 and a second bypass unit CP2.

Figure 13:
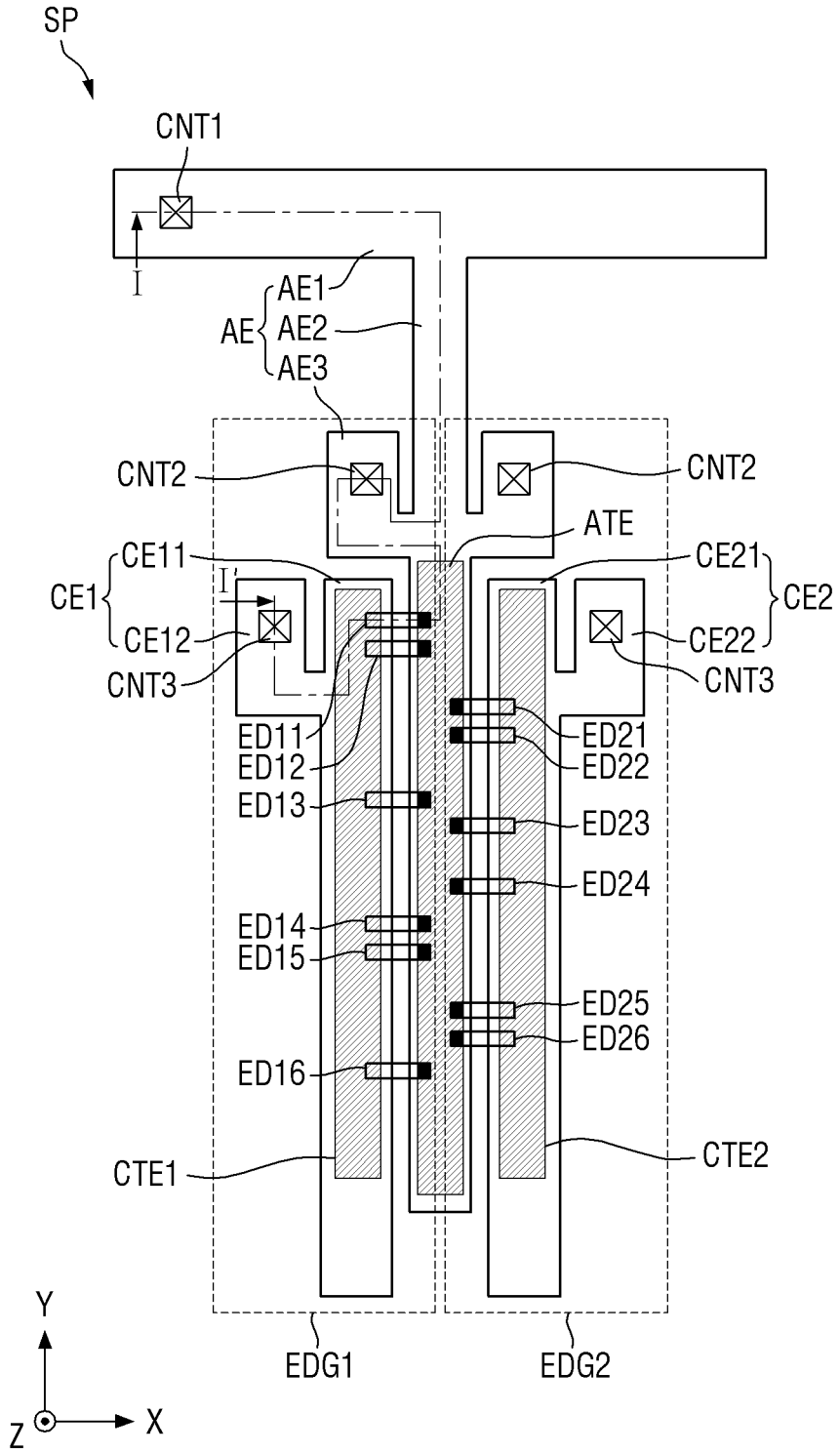
FIG. 13 is a plan view showing the plurality of light emitting groups of FIG. 12.

FIG. 13 is a plan view showing the plurality of light emitting groups of FIG. 12.

Referring to FIG. 13, the pixel SP may include a first electrode AE, a second-first electrode CE1, a second-second electrode CE2, a first light emitting group EDG1, a second light emitting group EDG2, a first contact electrode ATE, a second-first contact electrode CTE1, and a second-second contact electrode CTE2.

The first electrode AE may be connected to the plurality of light emitting elements ED of the first and second light emitting groups EDG1 and EDG2. The plurality of light emitting elements ED of the first and second light emitting groups EDG1 and EDG2 may share the first electrode AE. The first electrode AE may be connected to the fourth node N4 shown in FIG. 5 through the first contact hole CNT1. The first electrode AE may receive a voltage (e.g., a predetermined voltage) from the pixel circuit of the pixel SP, and the plurality of light emitting elements ED may emit light in a specific wavelength band. For example, the first electrode AE may be a pixel electrode separated in each of the plurality of pixels SP. The first electrodes AE of the respective pixels SP may receive different signals, and may be driven independently.

The first electrode AE may include a first portion AE1 extending in the first direction (X-axis direction), a second portion AE2 branched from the first portion AE1 and extending in the second direction (Y-axis direction), and a third portion AE3 protruding from the second portion AE2 in the first direction (X-axis direction) or a direction opposite to the first direction (X-axis direction).

The first portion AE1 of the first electrode AE of each of the plurality of pixels SP may be spaced from the first portion AE1 of the first electrode AE of the pixel adjacent thereto. The first portion AE1 of the first electrode AE may be disposed on the same imaginary extension line with the first portion AE1 of the first electrode AE of the adjacent pixel in the first direction (X-axis direction). The first portion AE1 of the first electrode AE may be electrically connected to the pixel circuit of the pixel SP through a first contact hole CNT1.

The second portion AE2 of the first electrode AE may be branched from the first portion AE1 and extend in the second direction (the Y-axis direction). One end of the second portion AE2 may be connected to the first portion AE1, and the other end of the second portion AE2 may be disposed between the second-first and second-second electrodes CE1 and CE2. The second portion AE2 of the first electrode AE may be disposed parallel to the first portions CE11 and CE21 of each of the second-first and second-second electrodes CE1 and CE2, and may be spaced therefrom.

The third portion AE3 of the first electrode AE may protrude from the second portion AE2 in the first direction (X-axis direction) or a direction opposite to the first direction (X-axis direction). For example, the third portion AE3 of the first electrode AE may protrude to the left side of the second portion AE2 to correspond to the second-first electrode CE1. Also, the third portion AE3 of the first electrode AE may protrude to the right side of the second portion AE2 to correspond to the second-second electrode CE2. The third portion AE3 of the first electrode AE may be connected to the first electrode of the compensation transistor TC through a second contact hole CNT2.

The third portion AE3 of the first electrode AE may include a protrusion portion protruding from the second portion AE2 and a bent portion bent from the protrusion portion. The protrusion portion of the third portion AE3 may protrude from the second portion AE2 in the first direction (X-axis direction) or a direction opposite to the first direction (X-axis direction), and the bent portion of the third portion AE3 may be bent from the protrusion portion and be disposed parallel to the second portion AE2. The bent portion of the third portion AE3 may have an area capable of accommodating the second contact hole CNT2.

The second-first and second-second electrodes CE1 and CE2 may correspond to the first and second light emitting groups EDG1 and EDG2, respectively. The second-first electrode CE1 may be connected to the first to sixth light emitting elements ED11 to ED16 of the first light emitting group EDG1, and the second-second electrode CE2 may be connected to the first to sixth light emitting elements ED21 to ED26 of the second light emitting group EDG2.

The first portion CE11 of the second-first electrode CE1 may extend in the second direction (the Y-axis direction). The first portion CE11 of the second-first electrode CE1 may be disposed parallel to the second portion AE2 of the first electrode AE, and may be insulated from the second portion AE2 of the first electrode AE. For example, the first portion CE11 of the second-first electrode CE1 may be disposed on the same line as the third portion AE3 of the first electrode AE, but the present disclosure is not limited thereto.

The second portion CE12 of the second-first electrode CE1 may protrude from the first portion CE11 in a direction opposite to the first direction (the X-axis direction). For example, the second portion CE12 of the second-first electrode CE1 may protrude to the left side of the first portion CE11. The second portion CE12 of the second-first electrode CE1 may be connected to the second electrode of the compensation transistor TC through a third contact hole CNT3.

The second portion CE12 of the second-first electrode CE1 may include a protrusion portion protruding from the first portion CE11 and a bent portion bent from the protrusion portion. The protrusion portion of the second portion CE12 may protrude from the first portion CE11 in a direction opposite to the first direction (X-axis direction), and the bent portion of the second portion CE12 may be bent from the protrusion portion and disposed parallel to the first portion CE11. The bent portion of the second portion CE12 may have an area capable of accommodating the third contact hole CNT3.

The first portion CE21 and the second portion CE22 of the second-second electrode CE2 may be disposed symmetrically with the first portion CE11 and the second portion CE12 of the second-first electrode CE1 based on the second portion AE2 of the first electrode AE. For example, the first portion CE21 and the second portion CE22 of the second-second electrode CE2 and the first portion CE11 and the second portion CE12 of the second-first electrode CE1 may be symmetric or symmetrically arranged with respect to the second portion AE2 of the first electrode AE.

The plurality of light emitting elements ED of the first and second light emitting groups EDG1 and EDG2 may be arranged by an electric field formed between the first electrode AE (e.g., the second portion AE2 of the first electrode AE) and the second-first and second-second electrodes CE1 and CE2. The first light emitting group EDG1 may include first to sixth light emitting elements ED11 to ED16 arranged between the first electrode AE and the second-first electrode CE1. The second light emitting group EDG2 may include first to sixth light emitting elements ED21 to ED26 arranged between the first electrode AE and the second-second electrode CE2.

Referring to FIG. 13 together with FIG. 12, the first light emitting group EDG1 may include a compensation transistor TC1 and a bypass resistance element RC1 connected between the first electrode AE and the second-first electrode CE1. The third portion AE3 of the first electrode AE may be connected to the first electrode of the compensation transistor TC1 through the second contact hole CNT2, and the second portion CE12 of the second-first electrode CE1 may be connected to the other end of the bypass resistance element RC1 through the third contact hole CNT3. The second emission group EDG2 may include a compensation transistor TC2 and a bypass resistance element RC2 connected between the first electrode AE and the second-second electrode CE2. The third portion AE3 of the first electrode AE may be connected to the first electrode of the compensation transistor TC2 through the second contact hole CNT2, and the second portion CE22 of the second-second electrode CE2 may be connected to the other end of the bypass resistance element RC2 through the third contact hole CNT3.

The light emitting elements ED may be disposed to be spaced from each other, and may be arranged to be substantially parallel to each other. The distance between the light emitting elements ED is not particularly limited. Some light emitting elements ED of the plurality of light emitting elements ED may be disposed adjacent to each other, other light emitting elements ED may be spaced from each other at regular intervals, and still other light emitting elements ED may be arranged in a specific direction with a nonuniform density. For example, each of the plurality of light emitting elements ED may be disposed in a direction perpendicular to the direction in which the second portion AE2 of the first electrode AE, the first portion CE11 of the second-first electrode CE1, or the first portion CE21 of the second-second electrode CE2 extends. In another example, each of the plurality of light emitting elements ED may be disposed in a direction oblique to the direction in which the second portion AE2 of the first electrode AE, the first portion CE11 of the second-first electrode CE1, or the first portion CE21 of the second-second electrode CE2 extends.

The light emitting elements ED may include active layers containing the same material to emit light in the same wavelength band or light of the same color. The plurality of pixels SP may emit light of the same color. For example, the light emitting elements ED may emit light having a peak wavelength in the range of 440 nm to 480 nm, such as blue light. Therefore, the light emitting element layer of the display device 10 may emit blue light. In another example, each of the plurality of pixels SP may include light emitting elements ED having different active layers, thereby emitting light with different colors.

The first contact electrode ATE may cover a part of the second portion AE2 of the first electrode AE. The first contact electrode ATE may electrically connect the second portion AE2 of the first electrode AE to the light emitting element ED. The first contact electrode ATE may directly contact the first semiconductor portion of the light emitting element ED.

The second-first contact electrode CTE1 may cover a part of the first portion CE11 of the second-first electrode CE1. The second-first contact electrode CTE1 may electrically connect the first portion CE11 of the second-first electrode CE1 to the light emitting element ED. For example, the second-first contact electrode CTE1 may directly contact the second semiconductor portion of each of the first to sixth light emitting elements ED11 to ED16 of the first light emitting group EDG1.

The second-second contact electrode CTE2 may cover a part of the first portion CE21 of the second-second electrode CE2. The second-second contact electrode CTE2 may electrically connect the first portion CE21 of the second-second electrode CE2 to the light emitting element ED. For example, the second-second contact electrode CTE2 may directly contact the second semiconductor portion of each of the first to sixth light emitting elements ED21 to ED26 of the second light emitting group EDG2.

Figure 14:
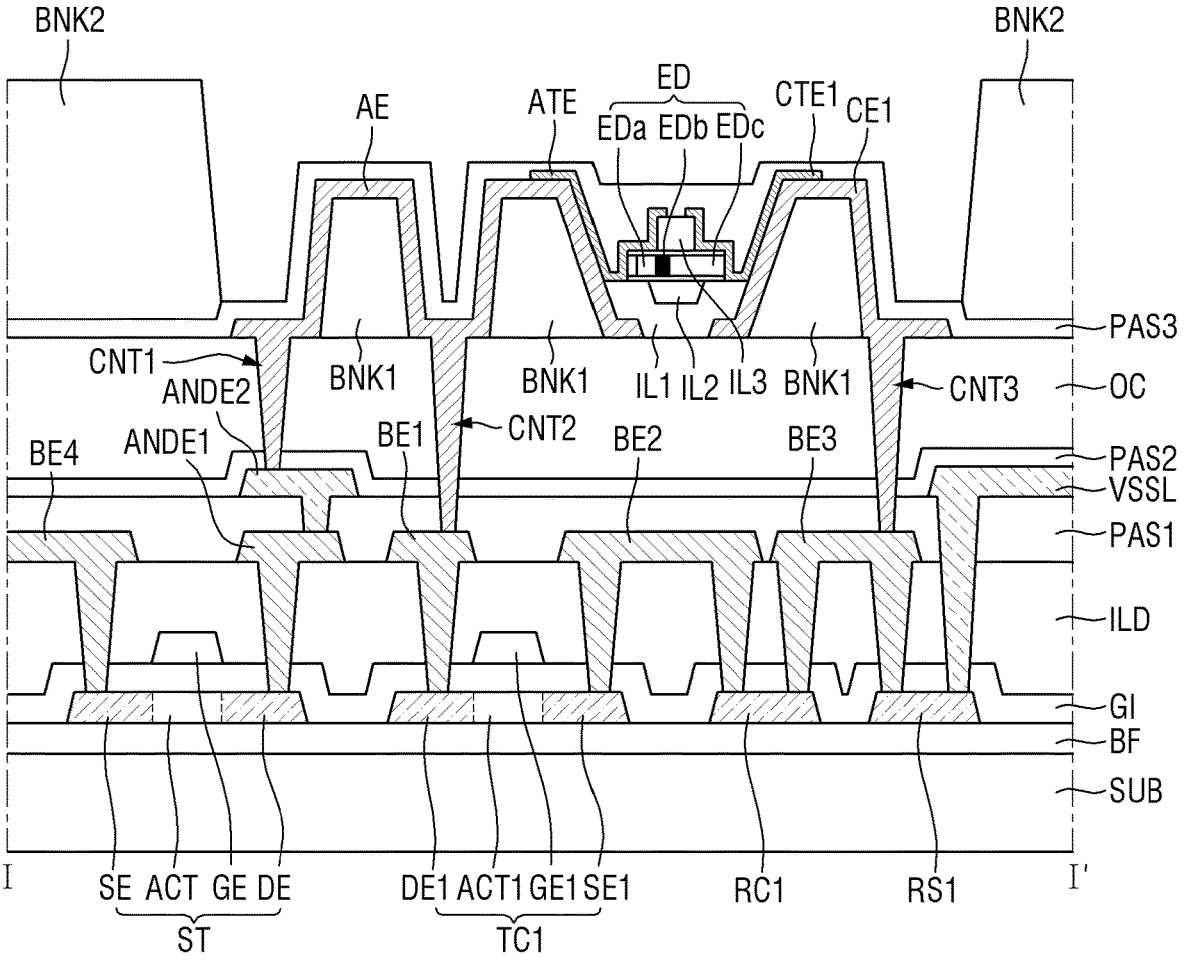
FIG. 14 is a cross-sectional view taken along the line I-I' of FIG. 13.

FIG. 14 is a cross-sectional view taken along the line I-I' of FIG. 13.

Referring to FIG. 14, the display device 10 may include a substrate SUB, a buffer layer BF, a thin film transistor layer TFTL, and a light emitting element layer EML.

The substrate SUB may be a base substrate or a base member, and may be made of an insulating material such as a polymer resin. For example, the substrate SUB may be a rigid substrate. When the substrate SUB is a rigid substrate, the substrate SUB may include a glass material or a metal material, but is not limited thereto. In another example, the substrate SUB may be a flexible substrate which can be bent, folded and rolled. When the substrate SUB is a flexible substrate, the substrate SUB may include polyimide (PI), but is not limited thereto.

The buffer layer BF may be disposed on the substrate SUB. The buffer layer BF may be formed of an inorganic film that is capable of preventing air or moisture infiltration. For example, the buffer layer BF may include a plurality of inorganic films laminated alternately.

The thin film transistor layer TFTL may include a thin film transistor ST, a compensation transistor TC1, a bypass resistance element RC1, a cathode resistance element RS1, a gate insulating layer GI, an interlayer insulating layer ILD, a first passivation layer PAS1, first and second anode connection electrodes ANDE1 and ANDE2, first to fourth connection electrodes BE1 to BE4, a low potential line VSSL, a second passivation layer PAS2, and a planarization layer OC.

The thin film transistor ST may be disposed on the buffer layer BF, and may constitute a pixel circuit of each of a plurality of pixels. For example, the thin film transistor ST may be a switching transistor of the pixel circuit. Referring to FIG. 14 together with FIG. 5, the thin film transistor ST may be a sixth transistor ST6 or a seventh transistor ST7 connected to the fourth node N4, which is the first electrode of the plurality of light emitting elements ED. The thin film transistor ST may include a semiconductor area ACT, a gate electrode GE, a first electrode SE, and a second electrode DE.

A semiconductor layer may be provided on the buffer layer BF. The semiconductor area ACT may be disposed in the semiconductor layer. The semiconductor area ACT may overlap the gate electrode GE in the thickness direction. The semiconductor area ACT may be disposed between the first electrode SE and the second electrode DE, and may overlap the gate electrode GE in the thickness direction of the substrate. The gate insulating layer GI may be disposed over the semiconductor area ACT, the semiconductor area ACT1, the bypass resistance element RC1, and the cathode resistance element RS1 to cover such elements.

The first electrode SE and the second electrode DE may be disposed in the semiconductor layer. The first electrode SE and the second electrode DE may be formed by making a part of the semiconductor layer conductive. The first electrode SE may be connected to the fourth connection electrode BE4, and the second electrode DE may be connected to the first anode connection electrode ANDE1.

The gate electrode GE may be arranged on the gate insulating layer GI. The gate electrode GE may overlap the semiconductor area ACT in the thickness direction. The gate electrode GE may be insulated from the semiconductor area ACT by the gate insulating layer GI.

The compensation transistor TC1 may be disposed on the buffer layer BF. The compensation transistor TC1 may include a semiconductor area ACT1, a gate electrode GE1, a first electrode DE1 and a second electrode SE1.

The semiconductor area ACT1 of the compensation transistor TC1 may be disposed in the semiconductor layer on the buffer layer BF. The semiconductor area ACT1 may overlap the gate electrode GE1. The semiconductor area ACT1 may be disposed between the first electrode DE1 and the second electrode SE1, and may overlap the gate electrode GE1 in a thickness direction.

The first electrode DE1 and the second electrode SE1 of the compensation transistor TC1 may be disposed in the semiconductor layer. The first electrode DE1 and the second electrode SE1 may be formed by making a part of the semiconductor layer conductive. The first electrode DE1 may be connected to the first electrode AE of the plurality of light emitting elements ED through the first connection electrode BE1, and the second electrode SE1 may be connected to the bypass resistance element RC1 through the second connection electrode BE2.

The gate electrode GE1 of the compensation transistor TC1 may be disposed on the gate insulating layer GI. The gate electrode GE1 may overlap the semiconductor area ACT1 in a thickness direction. The gate electrode GE1 may be insulated from the semiconductor area ACT1 by the gate insulating layer GI.

The bypass resistance element RC1 may be disposed in the semiconductor layer. The bypass resistance element RC1 may be formed by making a part of the semiconductor layer conductive. The bypass resistance element RC1 may correspond to a conductive pattern having a resistance value (e.g., a predetermined resistance value). The bypass resistance element RC1 may decrease the voltage of the second electrode SE1 of the compensation transistor TC1 when the driving current Isd flows through the compensation transistor TC1. One end of the bypass resistance element RC1 may be connected to the second electrode SE1 of the compensation transistor TC1 through the second connection electrode BE2. The other end of the bypass resistance element RC1 may be connected to the second-first electrode CE1 and the cathode resistance element RS1 through the third connection electrode BE3.

The cathode resistance element RS1 may be disposed in the semiconductor layer. The cathode resistance element RS1 may be formed by making a part of the semiconductor layer conductive. The cathode resistance element RS1 may correspond to a conductive pattern having a resistance value (e.g., a predetermined resistance value). The cathode resistance element RS1 may induce the current flowing through the plurality of light emitting elements ED to the low potential line VSSL. One end of the cathode resistance element RS1 may be connected to the bypass resistance element RC1 and the second-first electrode CE1 through the third connection electrode BE3. The other end of the cathode resistance element RS1 may be connected to the low potential line VSSL.

The gate insulating layer GI may be provided on the semiconductor layer. For example, the gate insulating layer GI may cover the semiconductor area ACT, the first electrode SE, and the second electrode DE of the thin film transistor ST. The gate insulating layer GI may insulate the gate electrode GE from the semiconductor area ACT of the thin film transistor ST. The gate insulating layer GI may cover the semiconductor area ACT1, the first electrode DE1, and the second electrode SE1 of the compensation transistor TC1. The gate insulating layer GI may insulate the gate electrode GE1 from the semiconductor area ACT1 of the compensation transistor TC1. The gate insulating layer GI may cover the bypass resistance element RC1 and the cathode resistance element RS1. For example, the gate insulating layer GI may include a contact hole through which the first anode connection electrode ANDE1 passes, a contact hole corresponding to each of the first to fourth connection electrodes BE1 to BE4 through which the first to fourth connection electrodes BE1 to BE4 pass, and a contact hole through which the low potential line VSSL passes.

The interlayer insulating layer ILD may be disposed on the gate electrode GE of the thin film transistor ST and the gate electrode GE1 of the compensation transistor TC1. For example, the interlayer insulating layer ILD may include a contact hole through which the first anode connection electrode ANDE1 passes, a contact hole corresponding to each of the first to fourth connection electrodes BE1 to BE4 through which the first to fourth connection electrodes BE1 to BE4 pass, and a contact hole through which the low potential line VSSL passes. The contact holes of the interlayer insulating layer ILD may be connected to the contact holes of the gate insulating layer GI.

The first conductive layer may be disposed on the interlayer insulating layer ILD. The first anode connection electrode ANDE1 and the first to fourth connection electrodes BE1 to BE4 may be disposed on the first conductive layer. The first anode connection electrode ANDE1 and the first to fourth connection electrodes BE1 to BE4 may be spaced from each other on the interlayer insulating layer ILD. The first anode connection electrode ANDE1 may connect the second electrode DE of the thin film transistor ST to the second anode connection electrode ANDE2. The first connection electrode BE1 may connect the first electrode AE to the first electrode DE1 of the compensation transistor TC1. The second connection electrode BE2 may connect the second electrode SE1 of the compensation transistor TC1 to the bypass resistance element RC1. The third connection electrode BE3 may connect the second-first electrode CE1, the bypass resistance element RC1, and the cathode resistance element RS1. The fourth connection electrode BE4 may be connected to the first electrode SE of the thin film transistor ST.

The first passivation layer PAS1 may be provided on the first conductive layer to protect the thin film transistor ST and the compensation transistor TC1. The first passivation layer PAS1 may cover the first anode connection electrode ANDE1 and the first to fourth connection electrodes BD to BE4. For example, the first passivation layer PAS1 may include a contact hole through which the second anode connection electrode ANDE2 passes and a contact hole through which the low potential line VSSL passes. The first passivation layer PAS1 may include a contact hole (e.g., second contact hole CNT2) through which the first electrode DE1 of the compensation transistor TC1 is connected to the first electrode AE.

The second conductive layer may be disposed on the first passivation layer PAS1. The second anode connection electrode ANDE2 and the low potential line VSSL may be disposed on the second conductive layer. The second anode connection electrode ANDE2 and the low potential line VSSL may be disposed to be spaced from each other on the first passivation layer PAS1. The second anode connection electrode ANDE2 may connect the first electrode AE to the first anode connection electrode ANDE1. The low potential line VSSL may be connected to the cathode resistance element RS1.

The second passivation layer PAS2 may be provided on the second conductive layer to protect the second anode connection electrode ANDE2 and the low potential line VSSL. For example, the second passivation layer PAS2 may include first and second contact holes CNT1 and CNT2, through which the first electrode AE passes, and a third contact hole CNT3, through which the second-first electrode CE1 passes.

The planarization layer OC may be provided on the second passivation layer PAS2 to planarize the top of the thin film transistor ST and the compensation transistor TC1. For example, the planarization layer OC may include first and second contact holes CNT1 and CNT2, through which the first electrode AE passes, and a third contact hole CNT3, through which the second-first electrode CE1 passes. The contact holes of the planarization layer OC may be connected to the contact hole of the second passivation layer PAS2.

The light emitting element layer EML may include a first bank BNK1, a first electrode AE, a second-first electrode CE1, a light emitting element ED, first to third insulating layers IL1, IL2, and IL3, a second bank BNK2, and a third passivation layer PAS3.

The first bank BNK1 may be disposed in an emission region or an opening region of the pixel SP. Each of the plurality of first banks BNK1 may correspond to the first electrode AE or the second-first electrode CE1. Each of the first electrode AE and the second-first electrode CE1 may be disposed on the corresponding first bank BNK1. The first bank BNK1 may include polyimide (PI), but is not limited thereto.

The first banks BNK1 may be disposed on the planarization layer OC, and the side surfaces of each of the first banks BNK1 may be inclined with respect to the planarization layer OC. The inclined surface of the first bank BNK1 may reflect the light emitted from the light emitting element ED. For example, each of the first electrode AE and the second-first electrode CE1 may include a material having high reflectivity and may be disposed on the inclined surface of the first bank BNK1 to reflect the light emitted from the light emitting element ED in the upward direction of the display device 10.

The first electrode AE of the plurality of light emitting elements ED may be disposed on the planarization layer OC and the first bank BNK1. For example, the first electrode AE of the plurality of light emitting elements ED may cover the first bank BNK1 disposed on the planarization layer OC. The first electrode AE of the plurality of light emitting elements ED may be disposed to overlap the emission region or the opening region defined by the second bank BNK2. The first electrode AE may be connected to the second anode connection electrode ANDE2 through the first contact hole CNT1. The first electrode AE may be connected to the second electrode DE of the thin film transistor ST through the first and second anode connection electrodes ANDE1 and ANDE2. The first electrode AE may be connected to the first connection electrode BE1 through the second contact hole CNT2. The first electrode AE may be connected to the second electrode SE1 of the compensation transistor TC1 through the first connection electrode BE1.

The second-first electrode CE1 may be disposed on the planarization layer OC and the first bank BNK1. For example, the second-first electrode CE1 may cover the first bank BNK1 disposed on the planarization layer OC. The second-first electrode CE1 may be disposed to overlap the emission region or the opening region defined by the second bank BNK2. The second-first electrode CE1 may be connected to the third connection electrode BE3 through the third contact hole CNT3. The second-first electrode CE1 may be connected to the bypass resistance element RC1 and the cathode resistance element RS1 through the third connection electrode BE3.

The first insulating layer IL1 may cover a part of the first electrode AE and a part of the second-first electrode CE1 that are adjacent to each other, and may insulate the first electrode AE from the second-first electrode CE1. For example, the first insulating layer IL1 may include an inorganic insulating material, and may include a depressed step between the first electrode AE and the second-first electrode CE1. The second insulating layer IL2 may fill the depressed step of the first insulating layer IL1. Therefore, the second insulating layer IL2 may planarize the top surface of the first insulating layer IL1, and the light emitting element ED may be disposed on the first and second insulating layers IL1 and IL2.

The light emitting element ED may be disposed between the first electrode AE and the second-first electrode CE1 on the planarization layer OC. The light emitting element ED may be disposed on the first and second insulating layers IL1 and IL2. One end of the light emitting element ED may be connected to the first electrode AE, and the other end of the light emitting element ED may be connected to the second-first electrode CE1. For example, the light emitting elements ED may include active layers EDb containing the same material to emit light in the same wavelength band or light of the same color. For example, the light emitting elements ED may emit light having a peak wavelength in the range of 440 nm to 480 nm, such as blue light. Therefore, the light emitting element layer EML may emit blue light.

The light emitting element ED may include a first semiconductor portion EDa, an active layer EDb, and a second semiconductor portion EDc.

The first semiconductor portion EDa may be connected to the first electrode AE through the first contact electrode ATE. The first semiconductor portion EDa may be a p-type semiconductor. When the light emitting element ED emits blue or green light, the first semiconductor portion EDa may include a semiconductor material having a chemical formula of AlxGayIn1-x-yN ($0 \le x \le 1$, $0 \le y \le 1$, $0 \le x+y \le 1$). For example, the first semiconductor portion EDa may include at least one semiconductor material of p-type doped AlGaInN, GaN, AlGaN, InGaN, AlN, or InN. The first semiconductor portion EDa may be doped with p-type dopants such as Mg, Zn, Ca, Se, and Ba. The first semiconductor portion EDa may be p-type Mg-doped p-GaN. The length of the first semiconductor portion EDa may be in a range of 0.05 μm to 0.10 μm, but is not limited thereto.

The active layer EDb may be disposed between the first and second semiconductor portions EDa and EDc. The active layer EDb may include a material having a single or multiple quantum well structure. When the active layer EDb includes a material having a multiple quantum well structure, where a plurality of quantum layers and well layers may be stacked alternately. The active layer EDb may emit light by coupling of electron-hole pairs according to an electric signal applied through the first and second semiconductor portions EDa and EDc. For example, when the active layer EDb emits blue light, a material such as AlGaN or AlGaInN may be included. When the active layer EDb has a multiple quantum well structure in which quantum layers and well layers are alternately stacked, the quantum layer may include a material such as AlGaN or AlGaInN, and the well layer may include a material such as GaN or AlInN. The active layer EDb may include AlGaInN as a quantum layer and AlInN as a well layer, thereby emitting blue light.

The second semiconductor portion EDc may be connected to the second-first electrode CE1 through the second-first contact electrode CTE1. The second semiconductor portion EDc may be an n-type semiconductor. When the light emitting element ED emits blue light, the second semiconductor portion EDc may include a semiconductor material having a chemical formula of AlxGayIn1-x-yN ($0 \le x \le 1$, $0 \le y \le 1$, $0 \le x+y \le 1$). For example, the second semiconductor portion EDc may include at least one semiconductor material of n-type doped AlGaInN, GaN, AlGaN, InGaN, AlN, or InN. The second semiconductor portion EDc may be doped with n-type dopants such as Si, Ge, and Sn. The second semiconductor portion EDc may be n-type Si-doped n-GaN.

The third insulating layer IL3 may be partially disposed on the light emitting element ED disposed between the first electrode AE and the second-first electrode CE1. The third insulating layer IL3 may partially surround the outer surface of the light emitting element ED. The third insulating layer IL3 may protect the light emitting element ED. The third insulating layer IL3 may surround the outer surface of the light emitting element ED without covering the two end portions adjacent to the first and second semiconductor portions EDa and EDc of the light emitting element ED.

The first contact electrode ATE may cover a part of the first electrode AE and the first semiconductor portion EDa of the light emitting element ED, and may electrically connect the first electrode AE to the light emitting element ED.

The second-first contact electrode CTE1 may cover a part of the second-first electrode CE1 and the second semiconductor portion EDc of the light emitting element ED, and may electrically connect the second-first electrode CE1 to the light emitting element ED.

The third passivation layer PAS3 may cover the first electrode AE, the second-first electrode CE1, the first contact electrode ATE, the second-first contact electrode CTE1, and the planarization layer OC. The third passivation layer PAS3 may prevent infiltration of impurities such as moisture or air from the outside, thereby preventing damage to the light emitting elements ED.

The second bank BNK2 may be disposed on the third passivation layer PAS3 to define an emission region or an opening region. For example, the second bank BNK2 may surround a plurality of emission regions or a plurality of opening regions. The second bank BNK2 may separate a plurality of first electrodes AE of the adjacent pixels SP from each other, and may separate a plurality of second-first electrodes CE1 of the adjacent pixels SP from each other.

Figure 15:
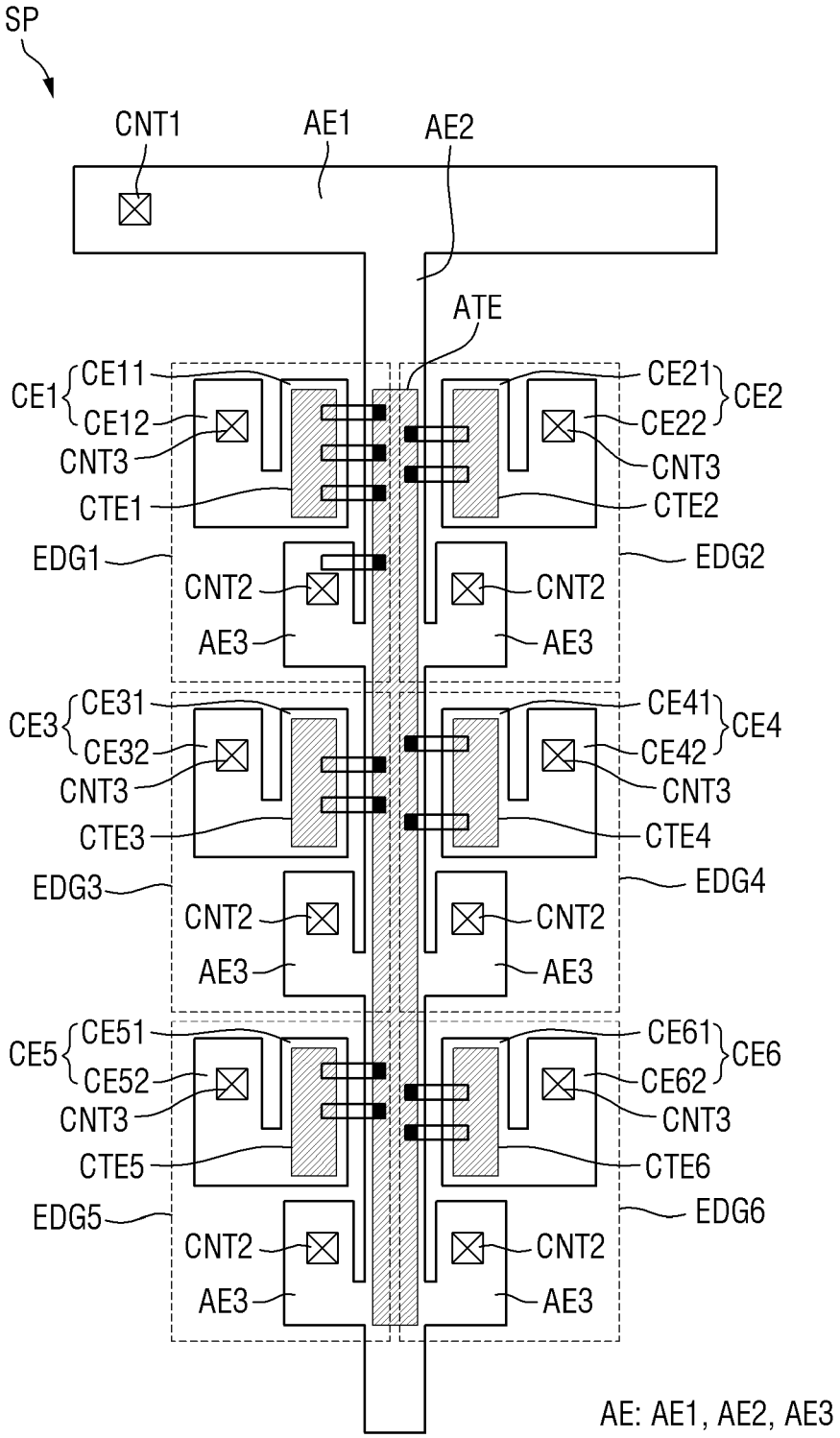
FIG. 15 is a plan view illustrating a plurality of light emitting groups in a display device according to yet another example embodiment.

FIG. 15 is a plan view illustrating a plurality of light emitting groups in a display device according to yet another example embodiment.

Referring to FIG. 15, a pixel SP may include a first electrode AE, second-first to second-sixth electrodes CE1 to CE6, first to sixth light emitting groups EDG1 to EDG6, and a first contact electrode ATE and second-first to second-sixth contact electrodes CTE1 to CTE6. Here, the number of the plurality of light emitting groups EDG, and the number of the plurality of second electrodes CE and the number of the plurality of second contact electrodes corresponding to the plurality of light emitting groups EDG may be freely changed according to design conditions, and are not limited to those shown in FIG. 15.

The first electrode AE may be connected to the plurality of light emitting elements ED of the first to sixth light emitting groups EDG1 to EDG6. The plurality of light emitting elements ED of the first to sixth light emitting groups EDG1 to EDG6 may share the first electrode AE. The first electrode AE may be connected to the fourth node N4 shown in FIG. 5 through the first contact hole CNT1. The first electrode AE may receive a voltage (e.g., a predetermined voltage) from the pixel circuit of the pixel SP, and the plurality of light emitting elements ED may emit light in a specific wavelength band. For example, the first electrode AE may be a pixel electrode separated in each of the plurality of pixels SP. The first electrodes AE of the respective pixels SP may receive different signals, and may be driven independently.

The first electrode AE may include a first portion AE1 extending in the first direction (X-axis direction), a second portion AE2 branched from the first portion AE1 and extending in the second direction (Y-axis direction), and a third portion AE3 protruding from the second portion AE2 in the first direction (X-axis direction) or a direction opposite to the first direction (X-axis direction).

The first portion AE1 of the first electrode AE of each of the plurality of pixels SP may be spaced from the first portion AE1 of the first electrode AE of the pixel adjacent thereto. The first portion AE1 of the first electrode AE may be disposed on an imaginary extension line with the first portion AE1 of the first electrode AE of the adjacent pixel in the first direction (the X-axis direction). The first portion AE1 of the first electrode AE may be electrically connected to the pixel circuit of the pixel SP through a first contact hole CNT1.

The second portion AE2 of the first electrode AE may be branched from the first portion AE1 and extend in the second direction (Y-axis direction). One end of the second portion AE2 may be connected to the first portion AE1, and the other end of the second portion AE2 may be disposed between the second-first to second-sixth electrodes CE1 and CE6. The second portion AE2 of the first electrode AE may be disposed parallel to the first portions CE11, CE21, CE31, CE41, CE51 and CE61 of each of the second-first to second-sixth electrodes CE1 to CE6, and may be spaced therefrom.

The third portion AE3 of the first electrode AE may protrude from the second portion AE2 in the first direction (the X-axis direction) or a direction opposite to the first direction (the X-axis direction). For example, the third portion AE3 of the first electrode AE may protrude to the left side of the second portion AE2 to correspond to the second-first electrode CE1, the second-third electrode CE3 or the second-fifth electrode CE5. Also, the third portion AE3 of the first electrode AE may protrude to the right side of the second portion AE2 to correspond to the second-second electrode CE2, the second-fourth electrode CE4 or the second-sixth electrode CE6. The third portion AE3 of the first electrode AE may be connected to the first electrode of the compensation transistor TC through a second contact hole CNT2.

The third portion AE3 of the first electrode AE may include a protrusion portion protruding from the second portion AE2 and a bent portion bent from the protrusion portion. The protrusion portion of the third portion AE3 may protrude from the second portion AE2 in the first direction (the X-axis direction) or a direction opposite to the first direction (the X-axis direction), and the bent portion of the third portion AE3 may be bent from the protrusion portion, and may be disposed parallel to the second portion AE2. The bent portion of the third portion AE3 may have an area capable of accommodating the second contact hole CNT2.

The second-first to second-sixth electrodes CE1 to CE6 may correspond to the first to sixth light emitting groups EDG1 to EDG6, respectively. The second-first to second-sixth electrodes CE1 to CE6 may be connected to the light emitting elements ED of the first to sixth light emitting groups EDG1 to EDG6, respectively.

The first portion CE11 of the second-first electrode CE1 may extend in the second direction (the Y-axis direction). The first portion CE11 of the second-first electrode CE1 may be disposed parallel to the second portion AE2 of the first electrode AE, and may be insulated from the second portion AE2 of the first electrode AE. For example, the first portion CE11 of the second-first electrode CE1 may be disposed on the same line as the third portion AE3 of the first electrode AE, but the present disclosure is not limited thereto.

The second portion CE12 of the second-first electrode CE1 may protrude from the first portion CE11 in a direction opposite to the first direction (the X-axis direction). For example, the second portion CE12 of the second-first electrode CE1 may protrude to the left side of the first portion CE11. The second portion CE12 of the second-first electrode CE1 may be connected to the second electrode of the compensation transistor TC through a third contact hole CNT3.

The second portion CE12 of the second-first electrode CE1 may include a protrusion portion protruding from the first portion CE11 and a bent portion bent from the protrusion portion. The protrusion portion of the second portion CE12 may protrude from the first portion CE11 in a direction opposite to the first direction (X-axis direction), and the bent portion of the second portion CE12 may be bent from the protrusion portion and disposed parallel to the first portion CE11. The bent portion of the second portion CE12 may have an area capable of accommodating the third contact hole CNT3.

The second-first, second-third and second-fifth electrodes CE1, CE3, and CE5 may be arranged in the same row. The second-first, second-third and second-fifth electrodes CE1, CE3, and CE5 may be arranged along the extension direction of the second portion AE2 of the first electrode AE. The second-first and second-third electrodes CE1 and CE3 may be spaced from each other, with the third portion AE3 of the first electrode AE interposed therebetween, and the second-third and second-fifth electrodes CE3 and CE5 may be spaced from each other, with the third portion AE3 of the first electrode AE interposed therebetween.

The second-second, second-fourth, and second-sixth electrodes CE2, CE4, and CE6 may be arranged in the same row. The second-second, second-fourth, and second-sixth electrodes CE2, CE4, and CE6 may be disposed symmetrically with the second-first, second-third and second-fifth electrodes CE1, CE3, and CE5, based on the second portion AE2 of the first electrode AE. For example, The second-second, second-fourth, and second-sixth electrodes CE2, CE4, and CE6 and the second-first, second-third, and second-fifth electrodes CE1, CE3, and CE5 may be symmetric or symmetrically arranged with respect to the second portion AE2 of the first electrode AE.

The plurality of light emitting elements ED of the first to sixth light emitting groups EDG1 to EDG6 may be arranged by an electric field formed between a corresponding one of the second-first to second-sixth contact electrodes CTE1 to CTE6 and the first electrode AE. The first light emitting group EDG1 may include light emitting elements ED arranged between the first electrode AE and the second-first electrode CE1. Each of the second to sixth light emitting groups EDG2 to EDG6 may include light emitting elements ED arranged between a corresponding one of second to sixth contact electrodes CTE2 to CTE6 and the first electrode AE.

The light emitting elements ED may be disposed to be spaced from each other, and may be arranged to be substantially parallel to each other. The distance between the light emitting elements ED is not particularly limited. Some light emitting elements ED of the plurality of light emitting elements ED may be disposed adjacent to each other, other light emitting elements ED may be spaced from each other at regular intervals, and still other light emitting elements ED may be arranged in a specific direction with a nonuniform density.

The first contact electrode ATE may cover a part of the second portion AE2 of the first electrode AE. The first contact electrode ATE may electrically connect the second portion AE2 of the first electrode AE to the light emitting element ED. The first contact electrode ATE may directly contact the first semiconductor portion EDa of the light emitting element ED.

The second-first contact electrode CTE1 may cover a part of the first portion CE11 of the second-first electrode CE1. The second-first contact electrode CTE1 may electrically connect the first portion CE11 of the second-first electrode CE1 to the light emitting element ED. For example, the second-first contact electrode CTE1 may directly contact the second semiconductor portion EDc of the light emitting element ED of the first light emitting group EDG1.

The second-second to second-sixth contact electrodes CTE2 to CTE6 may partially cover the first portions CE21, CE31, CE41, CE51 and CE61 of the second-second to second-sixth electrodes CE2 to CE6, respectively. Each of the second-second to second-sixth contact electrodes CTE2 to CTE6 may connect a corresponding one of the second-second to second-sixth electrodes CE2 to CE6 to the second semiconductor portion EDc of the light emitting element ED.

Figure 16:
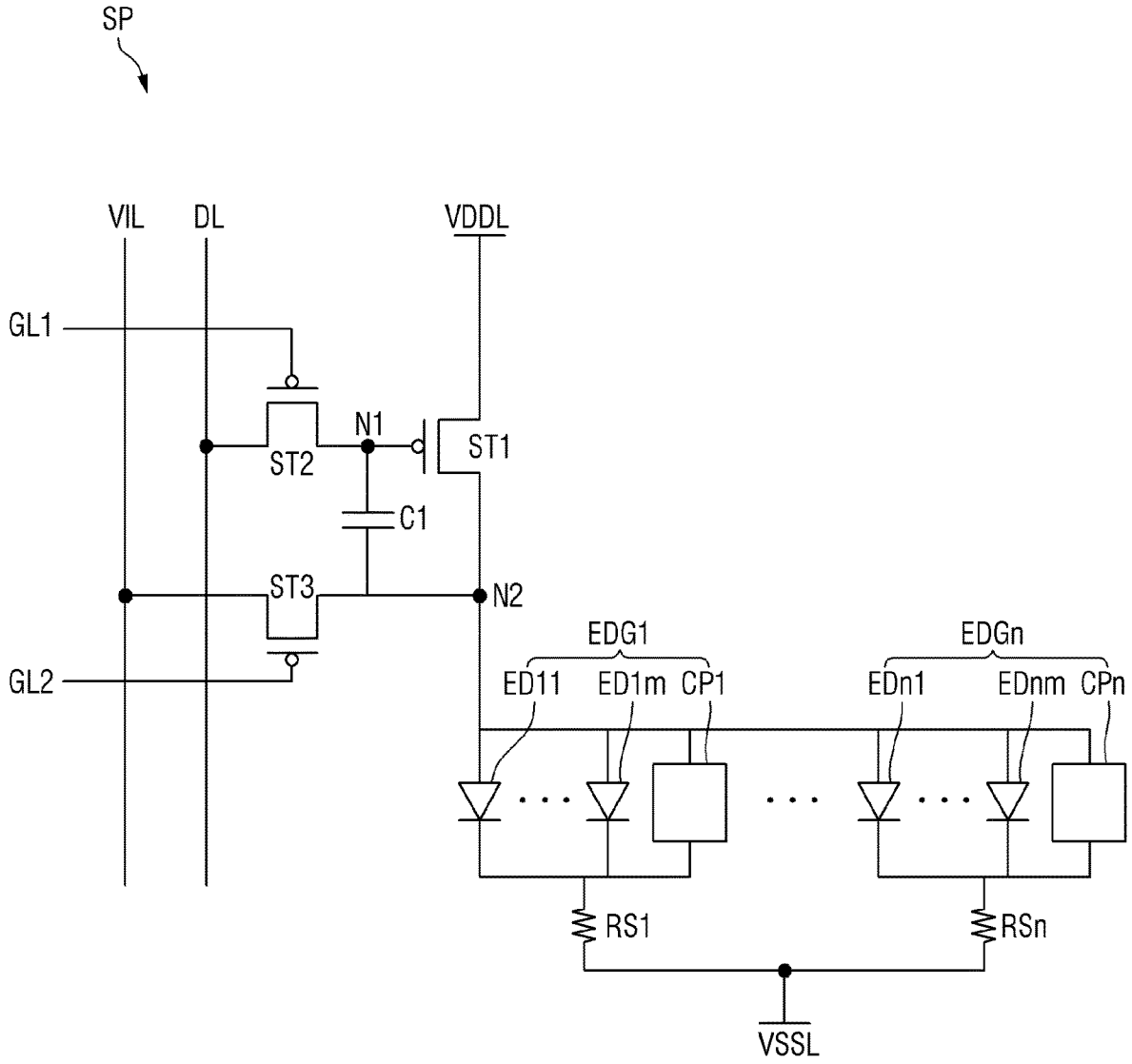
FIG. 16 is a circuit diagram showing a pixel of a display device according to yet another example embodiment.

FIG. 16 is a circuit diagram showing a pixel of a display device according to yet another example embodiment.

Referring to FIG. 16, each of the plurality of pixels SP may be connected to a first gate line GL1, a second gate line GL2, a data line DL, a driving voltage line VDDL, and an initialization voltage line VIL.

Each of the plurality of pixels SP may include a plurality of switching elements, a capacitor C1, and a plurality of light emitting groups EDG. The switching elements may include first to third transistors ST1, ST2, and ST3.

The first transistor ST1 may include a gate electrode, a first electrode, and a second electrode. The gate electrode of the first transistor ST1 may be connected to the first node N1, the first electrode thereof may be connected to the driving voltage line VDDL, and the second electrode thereof may be connected to a second node N2. The first transistor ST1 may control the source-drain current (or driving current) Isd according to the data voltage (hereinafter, denoted by "Vdata") applied to the gate electrode of the first transistor ST1.

Each of the plurality of light emitting groups EDG may include a plurality of light emitting elements ED. The light emitting elements ED may emit light by receiving the driving current Isd. The emission amount or the luminance of the light emitting element ED may be proportional to the magnitude of the driving current Isd. The light emitting element ED may be an inorganic light emitting element including a first electrode, a second electrode, and an inorganic semiconductor disposed between the first electrode and the second electrode. The first electrode of the plurality of light emitting elements ED may be connected to the second node N2. The first electrode of the plurality of light emitting elements ED may be connected through the second node N2 to the second electrode of the first transistor ST1 and the second electrode of the third transistor ST3.

The second transistor ST2 may be turned on by the gate signal (having a low-level gate on voltage) of the first gate line GL1 to connect the data line DL to the first node N1 which is the gate electrode of the first transistor ST1. The second transistor ST2 may be turned on according to the gate signal to supply the data voltage Vdata to the first node N1. The gate electrode of the second transistor ST2 may be connected to the first gate line GL1, the first electrode thereof may be connected to the data line DL, and the second electrode thereof may be connected to the first node N1. The second electrode of the second transistor ST2 may be connected through the first node N1 to the gate electrode of the first transistor ST1 and the first electrode of the capacitor C1.

The third transistor ST3 may be turned on by the gate signal (having a low-level gate on voltage) of the second gate line GL2 to connect the initialization voltage line VIL to the second node N2 which is the second electrode of the first transistor ST1. The third transistor ST3 may be turned on according to the gate signal to supply the initialization voltage VI to the second node N2. The gate electrode of the third transistor ST3 may be connected to the second gate line GL2, the first electrode thereof may be connected to the initialization voltage line VIL, and the second electrode thereof may be connected to the second node N2. The second electrode of the third transistor ST3 may be connected through the second node N2 to the second electrode of the first transistor ST1, the second electrode of the capacitor C1, and the first electrode of the plurality of light emitting groups EDG.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims and equivalents thereof.

What is claimed is:

1. A display device comprising:

a plurality of pixels on a substrate, each of the plurality of pixels comprising a pixel circuit to drive a plurality of light emitting elements, wherein the pixel circuit of each of the plurality of pixels comprises:

a first transistor configured to supply a driving current to a first electrode of the light emitting elements; and a plurality of light emitting groups, each of the light emitting groups comprising some of the light emitting elements and a bypass unit connected between the first electrode and a second electrode of the some of the light emitting elements to selectively bypass a part of the driving current, wherein the bypass unit comprises:

an amplifier configured to compare a voltage of the second electrode of the some of the light emitting elements with a reference voltage to supply an output voltage, and a compensation transistor connected to the first electrode of the some of the light emitting elements and configured to allow a part of the driving current to pass therethrough based on the output voltage of the amplifier.

2. The display device of claim 1, wherein the bypass unit is configured to allow a part of the driving current to pass therethrough based on a voltage of the second electrode of the some of the light emitting elements.

3. The display device of claim 1, wherein when some of the light emitting groups are electrically opened and the driving current does not pass therethrough, bypass units of other ones of the light emitting groups allow a part of the driving current to pass therethrough.

4. The display device of claim 1, wherein the amplifier is configured to output a gate-on voltage to turn on the compensation transistor when the voltage of the second electrode of the some of the light emitting elements is greater than the reference voltage.

5. The display device of claim 1, wherein the first electrode of the light emitting elements is connected to the first transistor, the pixel circuit further comprising a plurality of second electrodes respectively corresponding to the light emitting groups.

6. The display device of claim 5, wherein the first electrode comprises:

a first portion extending in a first direction; and a second portion protruding from the first portion in a second direction crossing the first direction.

7. The display device of claim 6, wherein each of the second electrodes comprises:

a first portion adjacent to the first portion of the first electrode; and a second portion protruding from the first portion of each of the second electrodes in an opposite direction to an extending direction of the first portion of the first electrode.

8. The display device of claim 7, wherein the bypass unit further comprises a compensation transistor connected between the first electrode and the second electrode of the some of the light emitting elements, the first electrode of the some of the light emitting elements is connected to the compensation transistor through a first contact hole in the second portion of the first electrode, and the second electrode of the some of the light emitting elements is connected to the compensation transistor through a second contact hole in the second portion of the second electrode.

9. The display device of claim 7, wherein the pixel circuit of each of the pixels further comprises:

a first contact electrode on the first portion of the first electrode and in direct contact with a first semiconductor portion of each of the light emitting elements; and a plurality of second contact electrodes, each being on the first portion of each of the second electrodes and in direct contact with a second semiconductor portion of each of the light emitting elements.

10. The display device of claim 5, wherein each of the second electrodes is connected to a corresponding one of a plurality of second conductive patterns, and the second conductive patterns are connected to one low potential line.

11. The display device of claim 1, wherein the pixel circuit of each of the pixels further comprises:

a second transistor selectively supplying a data voltage to a first node that is a first electrode of the first transistor;

a third transistor selectively connecting a second node that is a second electrode of the first transistor to a third node that is a gate electrode of the first transistor;

a fourth transistor selectively supplying an initialization voltage to the third node;

a fifth transistor selectively supplying a driving voltage to the first node;

a sixth transistor selectively connecting the second node to a fourth node which is a first electrode of the light emitting elements; and a seventh transistor selectively supplying the initialization voltage to the fourth node.

12. The display device of claim 1, wherein the pixel circuit of each of the pixels further comprises:

a second transistor selectively supplying a data voltage to a first node which is a gate electrode of the first transistor;

a third transistor selectively supplying an initialization voltage to a second node which is the first electrode of the light emitting elements; and a capacitor connected between the first node and the second node.

13. The display device of claim 1, wherein the some of the light emitting elements and the bypass unit are connected in parallel between the first transistor and a low-potential voltage of the display device.

14. A display device comprising:

a plurality of pixels on a substrate, each of the plurality of pixels comprising a pixel circuit to drive a plurality of light emitting elements, wherein the pixel circuit of each of the plurality of pixels comprises:

a first transistor configured to supply a driving current to a first electrode of the light emitting elements; and a plurality of light emitting groups, each of the light emitting groups comprising some of the light emitting elements and a bypass unit connected between the first electrode and a second electrode of the some of the light emitting elements to selectively bypass a part of the driving current, wherein the bypass unit comprises:

a compensation transistor connected to the first electrode of the some of the light emitting elements and is configured to turned on based on a voltage of the second electrode of the some of the light emitting elements; and a compensation diode connected between the compensation transistor and the second electrode of the some of the light emitting elements.

15. The display device of claim 14, wherein the compensation transistor is configured to supply a part of the driving current to the compensation diode when the voltage of the second electrode of the some of the light emitting elements is greater than a gate-on voltage.

16. A display device comprising:

a plurality of pixels on a substrate, each of the plurality of pixels comprising a pixel circuit to drive a plurality of light emitting elements, wherein the pixel circuit of each of the plurality of pixels comprises:

a first transistor configured to supply a driving current to a first electrode of the light emitting elements; and a plurality of light emitting groups, each of the light emitting groups comprising some of the light emitting elements and a bypass unit connected between the first electrode and a second electrode of the some of the light emitting elements to selectively bypass a part of the driving current, wherein the bypass unit comprises a compensation transistor connected to the first electrode of the some of the light emitting elements and is configured to turned on based on a voltage of the second electrode of the some of the light emitting elements to allow a part of the driving current to pass therethrough.

17. The display device of claim 16, wherein the bypass unit further comprises a first conductive pattern connected between the compensation transistor and the second electrode of the some of the light emitting elements, and when the voltage of the second electrode of the some of the light emitting elements is greater than a gate-on voltage, the compensation transistor supplies a part of the driving current to the first conductive pattern.

18. The display device of claim 7, further comprising:

a semiconductor layer on the substrate, wherein a semiconductor area of the first transistor, a semiconductor area of the compensation transistor, and the first conductive pattern are in the semiconductor layer.

19. The display device of claim 18, wherein the pixel circuit of each of the pixels further comprises:

a first connection electrode connecting the first electrode of the light emitting elements to a first electrode of the compensation transistor;

a second connection electrode connecting a second electrode of the compensation transistor to the first conductive pattern; and a third connection electrode connecting the first conductive pattern to the second electrode of the light emitting elements.

20. The display device of claim 19, wherein the pixel circuit of each of the pixels further comprises:

a first anode connection electrode at a same layer as at least one of the first to third connection electrodes and connected to a second electrode of the first transistor;

a second anode connection electrode on the first anode connection electrode to connect the first anode connection electrode to the first electrode of the light emitting elements;

a second conductive pattern in the semiconductor layer and connected to the third connection electrode; and a low potential line at a same layer as the second anode connection electrode and connected to the second conductive pattern.

* * * * *